US009809034B2

(12) United States Patent
Aoki et al.

(10) Patent No.: US 9,809,034 B2
(45) Date of Patent: Nov. 7, 2017

(54) LIQUID SUPPLY UNIT HAVING FILTER

(71) Applicant: SEIKO EPSON CORPORATION, Tokyo (JP)

(72) Inventors: Yuji Aoki, Hara-mura (JP); Masahiro Karasawa, Nagano (JP); Kazuyuki Hirata, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 5 days.

(21) Appl. No.: 15/096,699

(22) Filed: Apr. 12, 2016

(65) Prior Publication Data

US 2016/0311228 A1 Oct. 27, 2016

(30) Foreign Application Priority Data

Apr. 23, 2015 (JP) ..... 2015-088167

(51) Int. Cl.
*B41J 2/175* (2006.01)

(52) U.S. Cl.
CPC ..... *B41J 2/17563* (2013.01); *B41J 2/17513* (2013.01); *B41J 2/1752* (2013.01); *B41J 2002/17516* (2013.01)

(58) Field of Classification Search
CPC ..... B41J 2/17563; B41J 2/17513; B41J 2002/17516; B41J 2/1752; B41J 2/17523; B41J 2/17509; B41J 2/175; B41J 2/17503
See application file for complete search history.

(56) References Cited

U.S. PATENT DOCUMENTS 5,657,065 A * 8/1997 Lin ..... B41J 2/17526 347/87
5,781,213 A * 7/1998 Ujita ..... B41J 2/165 347/86
2003/0071874 A1* 4/2003 Ishizawa ..... B41J 2/175 347/50
2009/0212460 A1 8/2009 Kamikura
(Continued)

FOREIGN PATENT DOCUMENTS

EP 1693212 A1 8/2006
EP 2360019 A1 8/2011
(Continued)

OTHER PUBLICATIONS

The Extended European Search Report for the corresponding European Application No. 161619334.1 dated Sep. 27, 2016.

*Primary Examiner* — Henok Legesse
(74) *Attorney, Agent, or Firm* — Global IP Counselors, LLP

(57) ABSTRACT

A liquid supply unit configured to supply a liquid to a liquid inlet of a liquid jet apparatus. The liquid supply unit includes a liquid housing part configured to house a liquid, a liquid outlet configured to draw the liquid from inside the liquid housing part to outside the liquid housing part, and a filter provided upstream of the liquid outlet in a channel of the liquid that is drawn from inside the liquid housing part to outside the liquid housing part via the liquid outlet. The filter includes a first filter and a second filter that are constituted by a plurality of fibers laminated in a flow direction of the liquid. The first filter is provided upstream of the second filter in the channel of the liquid, and the first filter and the second filter differ in coarseness.

12 Claims, 24 Drawing Sheets

(56) References Cited

U.S. PATENT DOCUMENTS

| | | | | |
|---|---|---|---|---|
| 2014/0009542 | A1* | 1/2014 | Usui | B41J 2/17513 347/86 |
| 2014/0022320 | A1 | 1/2014 | Hays et al. | |
| 2014/0361023 | A1 | 12/2014 | Nose et al. | |
| 2015/0097902 | A1 | 4/2015 | Nagashima et al. | |

FOREIGN PATENT DOCUMENTS

| | | | |
|---|---|---|---|
| EP | 2810780 | A2 | 12/2014 |
| GB | 2269784 | A | 2/1994 |
| JP | 2014-233947 | A | 12/2014 |
| WO | 2009/126137 | A1 | 10/2009 |

* cited by examiner

LIQUID SUPPLY UNIT HAVING FILTER

Priority is claimed under 35 U.S.C. §119 to Japanese Application No. 2015-088167 filed on Apr. 23, 2015 which is hereby incorporated by reference in its entirety.

BACKGROUND

1. Technical Field

The present invention relates to liquid supply units and the like.

2. Related Art

One example of a liquid supply unit is an ink cartridge that is applied to an inkjet recording apparatus. Ink cartridges in which a bag-like pack housed inside a case is provided with a built-in filter capable of filtering ink inside the pack are heretofore known (refer to, for example, JP-A-2014-233947).

The filter desirably catches soft contaminants as well as hard contaminants. There are some soft contaminants that readily change shape such as gel-like contaminants, for example. Such soft contaminants may pass through filter mesh even if the outer shape of the contaminants is larger than the mesh. One reason is that even if contaminants having a larger outer shape than the filter mesh are initially caught in the filter, soft contaminants end up passing through the mesh due to the contaminants gradually changing shape. Thus, with existing liquid supply units, there is a problem in that it is difficult to reduce the outflow of contaminants.

SUMMARY

An advantage of some aspects of the invention can be realized as the following modes or application examples.

Application Example 1

A liquid supply unit configured to, with respect to a liquid jet apparatus having a liquid inlet configured to introduce a liquid, supply the liquid to the liquid inlet, includes a liquid housing part configured to house a liquid, a liquid outlet configured to draw the liquid from inside the liquid housing part to outside the liquid housing part, and a filter provided upstream of the liquid outlet in a channel of the liquid that is drawn from inside the liquid housing part to outside the liquid housing part via the liquid outlet. The filter includes a first filter and a second filter that are constituted by a plurality of fibers laminated in a flow direction of the liquid. The first filter is provided upstream of the second filter in the channel of the liquid, and the first filter and the second filter differ in coarseness.

With this application example, the first filter and the second filter are each constituted by a plurality of fibers laminated in the flow direction of the liquid, and differ from each other in coarseness. According to this configuration, even if contaminants get into the openings in the first filter, the contaminants are readily prevented from advancing by the plurality of fibers laminated in the flow direction of the liquid. Also, because the second filter is downstream of the first filter, contaminants that get through the first filter are readily caught by the second filter. Therefore, with this liquid supply unit, the outflow of contaminants is readily reduced.

Application Example 2

The above liquid supply unit in which it may be preferable that the first filter is coarser than the second filter.

With this application example, the first filter is coarser than the second filter. To put it another way, the second filter is finer than the first filter. Contaminants that get through the first filter are thus readily caught with the second filter.

Application Example 3

The above liquid supply unit in which it may be preferable that an average fiber diameter of the plurality of fibers in the first filter differs from an average fiber diameter of the plurality of fibers in the second filter.

With this application example, because the average fiber diameter of the plurality of fibers in the first filter differs from the average fiber diameter of the plurality of fibers in the second filter, the coarseness of the first filter and the coarseness of the second filter can be differentiated from each other.

Application Example 4

The above liquid supply unit in which it may be preferable that the first filter and the second filter contact each other.

With this application example, because the first filter and the second filter contact each other, contaminants that appear likely to get through the first filter can be readily prevented from passing through the first filter by the second filter.

Application Example 5

The above liquid supply unit in which it may be preferable that the first filter and the second filter are integrally constituted.

With this application example, because the first filter and the second filter are integrally constituted, the opening of a gap between the first filter and the second filter can be suppressed to a minimum. Contaminants are thereby more readily prevented from passing through the first filter by the second filter.

Application Example 6

The above liquid supply unit in which it may be preferable that the plurality of fibers in the first filter and the plurality of fibers in the second filter are metal fibers.

With this application example, because the plurality of fibers in the first filter and the plurality of fibers in the second filter are metal fibers, the liquid and the filters do not readily react to each other and undergo chemical change.

Application Example 7

The above liquid supply unit in which it may be preferable that the first filter and the second filter are nonwoven fabric.

With this application example, because the first filter and the second filter are nonwoven fabric, even if contaminants get into the openings of the filter, the contaminants are readily prevented from advancing by the plurality of fibers laminated in the flow direction of the liquid. Contaminants are thereby readily caught by the filter.

Application Example 8

The above liquid supply unit in which it may be preferable that the liquid supply unit includes a channel member constituting at least a portion of the channel leading from inside the liquid housing part to the liquid outlet, and the filter is provided in the channel member.

With this application example, liquid within the liquid housing part can be filtered with the filter provided in the channel member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
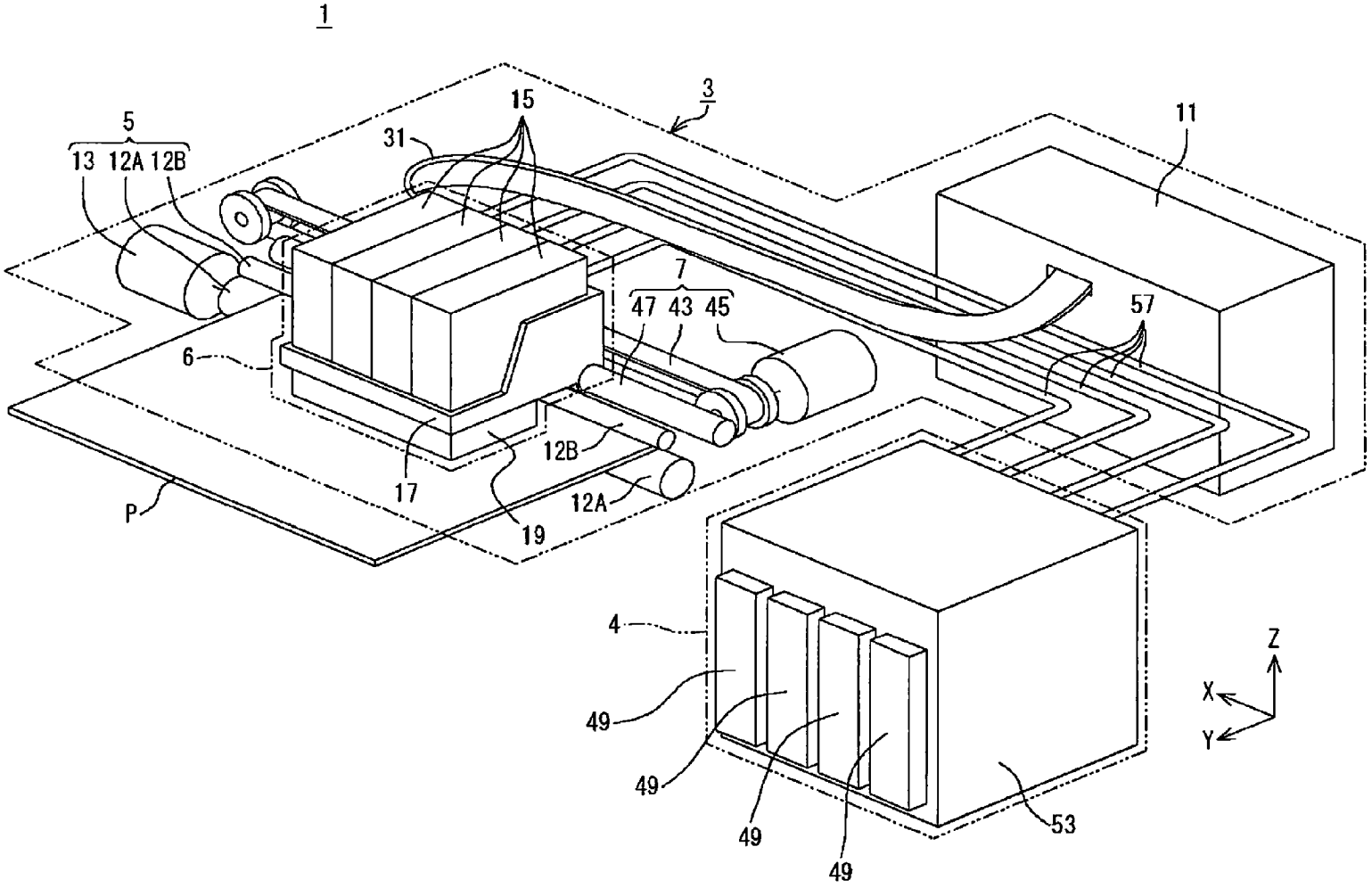
FIG. 1 is a perspective view showing the main configuration of a liquid jet system in one embodiment.

Embodiments will be described with reference to the drawings, taking a liquid jet system as an example. Note that, in the drawings, the scale of constituent elements and members may differ from actual size, in order to show the respective elements at a recognizable size.

A liquid jet system 1 in the present embodiment has, as shown in FIG. 1, a printer 3, which is an example of a liquid jet apparatus, and an ink supply apparatus 4, which is an example of a liquid supply apparatus. The printer 3 has a conveyance apparatus 5, a recorder 6, a move apparatus 7 and a controller 11. Note that XYZ axes, which are coordinate axes orthogonal to each other, are given in FIG. 1. The XYZ axes are also given as necessary in the following diagrams. In the present embodiment, the liquid jet system 1 is in a use state when disposed in a horizontal plane (XY plane) defined by the X-axis and the Y-axis. The Z-axis is orthogonal to the horizontal plane. In the use state of the liquid jet system 1, the Z-axis direction is oriented vertically upward. Also, in the use state of the liquid jet system 1, the −Z-axis is oriented vertically downward in FIG. 1. Note that, with each of the XYZ axes, the arrow points in the +ve (positive) direction, and the opposite direction to the direction of the arrow is the −ve (negative) direction.

The conveyance apparatus 5 intermittently conveys recording media P such as recording paper in the Y-axis direction. The recorder 6 records onto the recording media P that is conveyed by the conveyance apparatus 5 with ink, which is an example of a liquid. The move apparatus 7 moves the recorder 6 back and forth along the X-axis. The ink supply apparatus 4 supplies ink to the recorder 6. The controller 11 controls the drive of each of the above constituent elements.

Here, the direction along the X-axis is not limited to a direction perfectly parallel to the X-axis, and also includes directions that are not parallel due to error, tolerance or the like, excluding directions orthogonal to the X-axis. Also, the direction along the Y-axis is not limited to a direction perfectly parallel to the Y-axis, and also includes directions that are not parallel due to error, tolerance or the like, excluding directions orthogonal to the Y-axis. Similarly the direction along the Z-axis is not limited to a direction perfectly parallel to the Z-axis, and also includes directions that are not parallel due to error, tolerance or the like, excluding directions orthogonal to the Z-axis. In other words, the direction along arbitrary axes and planes is not limited to a direction perfectly parallel to those arbitrary axes and planes, and also includes directions that are not parallel due to error, tolerance or the like, excluding directions orthogonal to those arbitrary axes and planes.

The conveyance apparatus 5 has a drive roller 12A, a driven roller 12B and a conveyance motor 13, as shown in FIG. 1. The drive roller 12A and the driven roller 12B are configured to contact each other at peripheries thereof and be rotatable. The conveyance motor 13 produces power for rotationally driving the drive roller 12A. The power from the conveyance motor 13 is transmitted to the drive roller 12A via a transmission mechanism. Also, recording media P sandwiched between the drive roller 12A and the driven roller 12B is intermittently conveyed in the Y-axis direction.

The recorder 6 is provided with four relay units 15, a carriage 17, and a recording head 19. The relay unit 15 relays ink supplied from the ink supply apparatus 4 to the recording head 19. The recording head 19 is an example of a liquid jet part, and functions to eject ink as ink droplets and record onto the recording media P. The carriage 17 is equipped with the four relay units 15 and the recording head 19. Note that the recording head 19 is connected to the controller 11 via a flexible cable 31. The ejection of ink droplets from the recording head 19 is controlled by the controller 11.

The move apparatus 7 is provided with a timing belt 43, a carriage motor 45 and a guide shaft 47, as shown in FIG. 1. The timing belt 43 is stretched in a tensioned state along the X-axis. The carriage 17 is fixed to a portion of the timing belt 43. The carriage motor 45 produces power for driving the timing belt 43. The guide shaft 47 extends along the X-axis. The guide shaft 47 is supported at both ends by a chassis which is not illustrated, and guides the carriage 17 along the X-axis. Power is transmitted to the carriage 17 from the carriage motor 45 via the timing belt 43. The carriage 17 is configured to be movable back and forth along the X-axis by the transmitted power.

A cartridge 49, which is an example of a liquid supply unit, is detachably mounted in the ink supply apparatus 4, as shown in FIG. 1. The ink supply apparatus 4 has a holder 53. Note that, in the present embodiment, a plurality of (four in the present embodiment) cartridges 49 can be mounted in the ink supply apparatus 4. The four cartridges 49 are detachably supported in relation to the holder 53. A pack unit (discussed later), which is an example of a liquid housing body, is housed inside the cartridge 49. The pack unit has an ink housing part, which is an example of a liquid housing part. Ink is sealed in the ink housing part, which is constituted by a flexibility film material. With the cartridge 49 in the present embodiment, the pack unit housed inside the cartridge 49 is configured to be replaceable. In the liquid jet system 1, the pack unit in the cartridge 49 is replaced with a new pack unit when the ink in the ink housing part is consumed.

An ink supply tube 57 is connected to the pack unit in each cartridge 49. The ink supply tube 57, which is an example of a channel member, is connected from the ink supply apparatus 4 to each relay unit 15. The four relay units 15 are each connected to the pack unit of a different one of the cartridges 49 via the ink supply tube 57. The ink in each cartridge 49 is sent to the relay unit 15 via the ink supply tube 57. The ink inside the cartridges 49 is thus supplied from the ink supply apparatus 4 to the recording head 19 via the relay units 15. The ink supplied to the recording head 19 is ejected as ink droplets from nozzles (not shown) oriented toward the recording media P side. Note that in the above example, the printer 3 and the ink supply apparatus 4 were described as being separate constituent elements, but the ink supply apparatus 4 can also be included in the configuration of the printer 3.

In the liquid jet system 1 having the above configuration, the drive of the conveyance motor 13 is controlled by the controller 11, and the conveyance apparatus 5 intermittently conveys the recording media P in the Y-axis direction so as to oppose the recording head 19. At this point, the controller 11 controls the drive of the carriage motor 45 to move the carriage 17 back and forth along the X-axis, and controls the drive of the recording head 19 to eject ink droplets at predetermined positions. Dots are formed on the recording media P by such operations, and recording based on recording information such as image data is performed on this recording media P.

Figure 2:
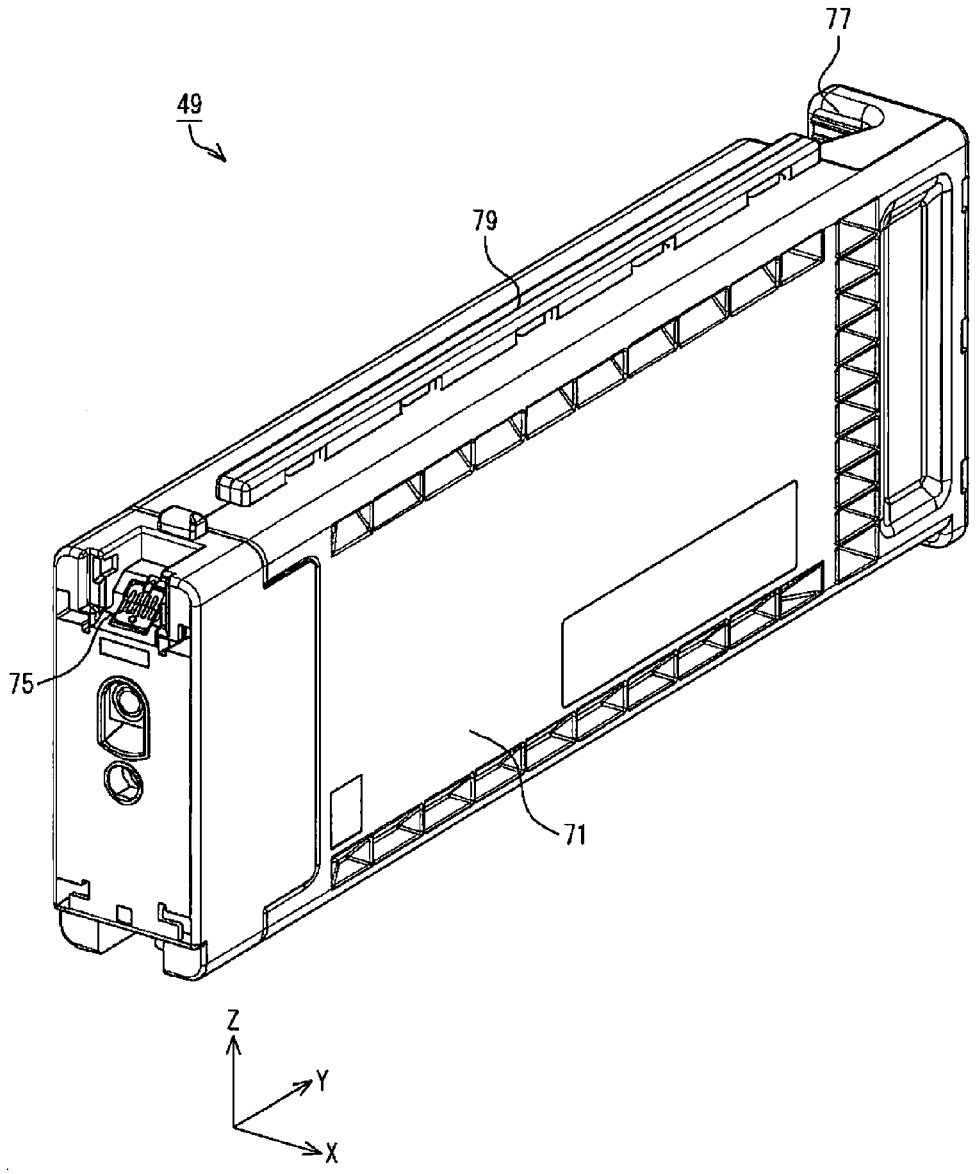
FIG. 2 is a perspective view showing a cartridge in one embodiment.

The cartridge 49 has a case 71 and a substrate 75, as shown in FIG. 2. The case 71 is provided with a handle 77 and a rail 79. A user is able to hold the cartridge 49 by grasping the handle 77 when attaching and detaching the cartridge 49 with respect to the holder 53 (FIG. 1). The substrate 75 is provided in the case 71. In the case 71, the substrate 75 is provided on the opposite side to the handle 77 side of the case 71. A plurality of terminals are provided on the substrate 75. Also, a storage device (not shown) electrically connected to the terminals of the substrate 75 is provided on the rear side of the substrate 75. Information relating to the ink housed inside the cartridge 49, for example, is recorded in the storage device.

Here, the X-axis, the Y-axis and the Z-axis in FIG. 2 correspond to the X-axis, the Y-axis and the Z-axis for the liquid jet system 1 shown in FIG. 1. That is, the X-axis, the Y-axis and the Z-axis in FIG. 2 indicate the X-axis, the Y-axis and the Z-axis in a state where the cartridge 49 is mounted in the liquid jet system 1. Similarly, in the case where the X-axis, the Y-axis and the Z-axis are given hereafter in diagrams showing constituent components and/or units of the liquid jet system 1, these axes indicate the X-axis, the Y-axis and the Z-axis in a state where the constituent components and/or units are mounted in the liquid jet system 1.

When mounting the cartridge 49 in the holder 53 (FIG. 1), the cartridge 49 is inserted into the holder 53 from the opposite side of the case 71 to the handle 77 side, that is, from the substrate 75 side of cartridge 49. At this point, the cartridge 49 is guided inside the holder 53 along the Y-axis by the rail 79 of the cartridge 49 being inserted into a guidance slot of the holder 53 which is not illustrated. A contact mechanism which is not illustrated is provided inside the holder 53. The contact mechanism inside the holder 53 is electrically connected to the controller 11. When the cartridge 49 is mounted in the holder 53, the plurality of terminals of the substrate 75 abut against the contact mechanism inside the holder 53. Transfer of information thereby becomes possible between the storage device provided in the substrate 75 and the controller 11.

Figure 3:
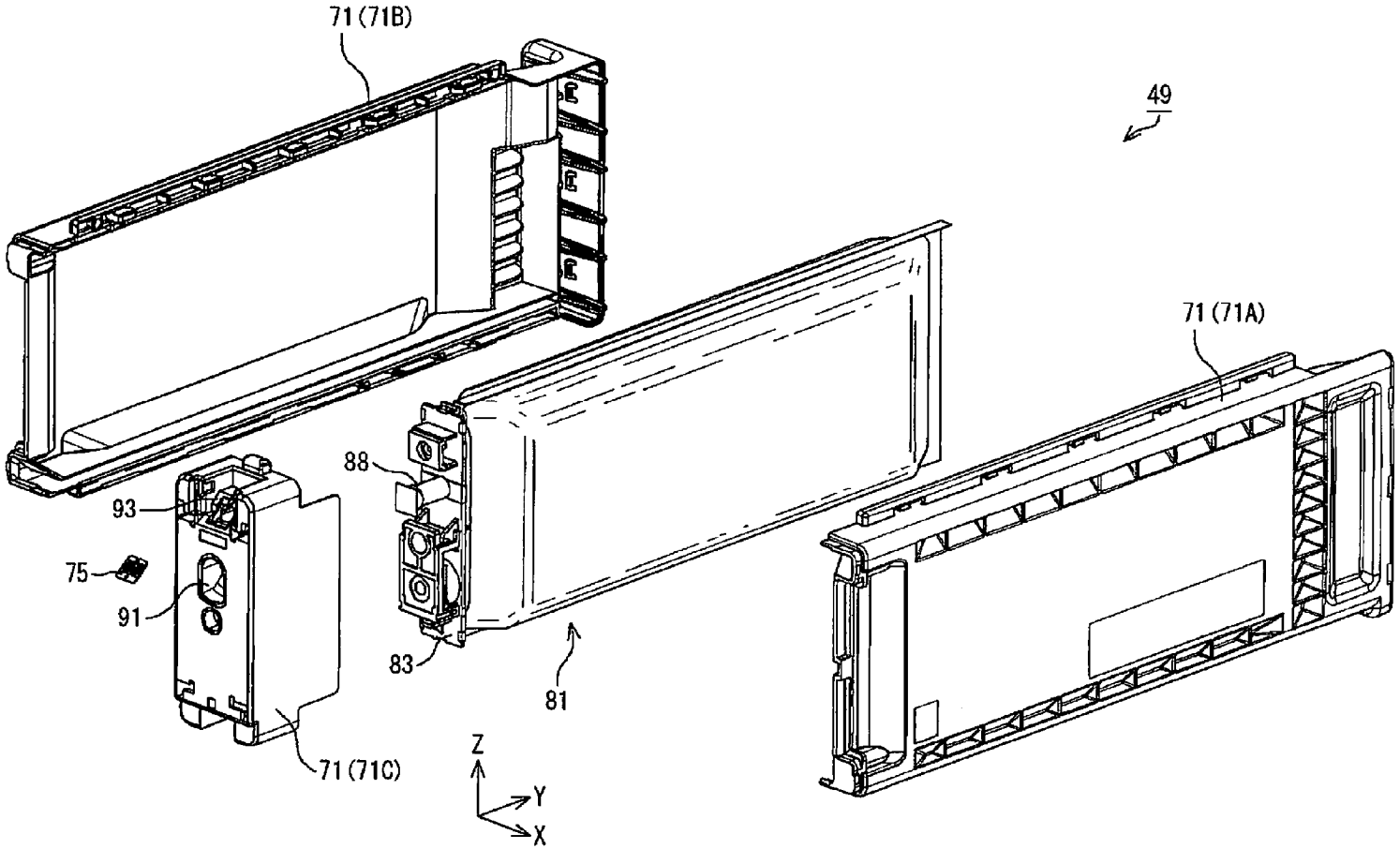
FIG. 3 is an exploded perspective view showing a cartridge in one embodiment.

The case 71 has a first case 71A, a second case 71B and a third case 71C, as shown in FIG. 3. Also, the cartridge 49 has a pack unit 81. The substrate 75 is provided in the third case 71C. When the first case 71A, the second case 71B and the third case 71C are assembled as the case 71, a space is formed inside the case 71. The pack unit 81 is housed in the space inside the case 71.

Figure 4:
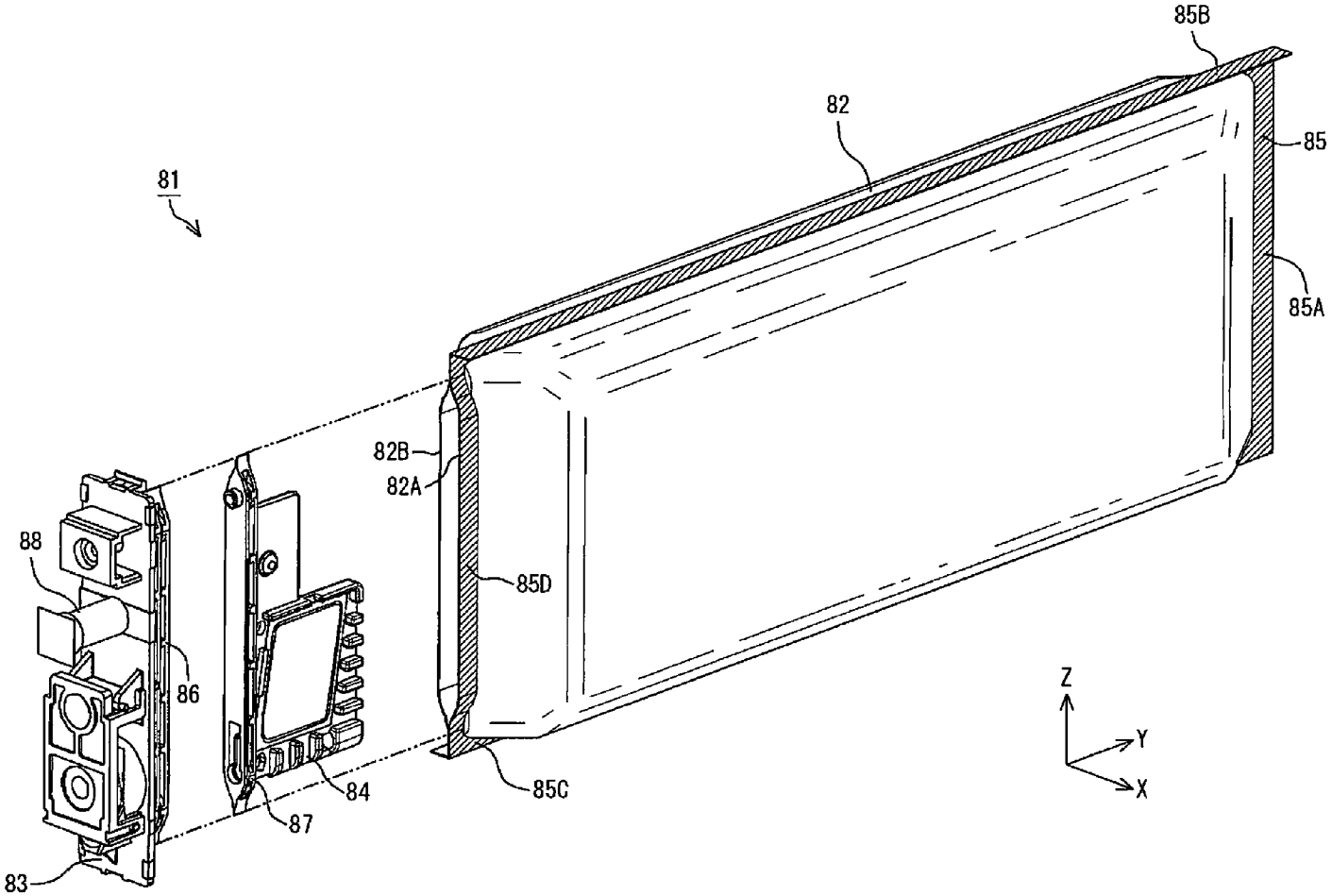
FIG. 4 is an exploded perspective view showing a pack unit in one embodiment.

The pack unit 81 has an ink pack 82, which is an example of an ink housing part, a channel unit 83 and a filter unit 84, as shown in FIG. 4. The ink pack 82 has a sheet 82A as a sheet member and a sheet 82B as a sheet member. The sheet 82A and the sheet 82B are welded together around a peripheral area 85, in a state of being overlaid one on the other. The ink pack 82 thereby has a bag-like form. Ink is housed inside the ink pack 82. Note that a bag-like configuration formed by folding a single sheet member and joining the peripheral area 85 may be employed as the configuration of the ink pack 82.

Hereinafter, in the case of identifying the end portion of the peripheral area 85 in the Y-axis direction of the ink pack 82 from other regions of the peripheral area 85, the end portion in the Y-axis direction of the ink pack 82 will be denoted as an end portion 85A. Also, in the case of identifying the upper end portion of the peripheral area 85 in the Z-axis direction from other regions of the peripheral area 85, the upper end portion in the Z-axis direction will be denoted as an end portion 85B. Similarly, in the case of identifying the lower end portion of the peripheral area 85 in the Z-axis direction from other regions of the peripheral area 85, the lower end portion in the Z-axis direction will be denoted as an end portion 85C. In this case, the end portion 85A is located in the Y direction, which is the direction intersecting the direction connecting the end portion 85B and the end portion 85C in the Z-axis direction. Also, the end portion on the opposite side to the end portion 85A in the Y-axis direction will be denoted as an end portion 85D.

Materials such as polyethylene terephthalate (PET), nylon and polyethylene, for example, can be employed for the sheet 82A and the sheet 82B. Also, a laminated structure obtained by laminating films constituted by these materials may also be employed. With such a laminated structure, PET or nylon which have excellent shock resistance can be used for the outer layer, and polyethylene which has excellent ink resistance can be used for the inner layer, for example. Furthermore, a film or the like having a layer obtained by vapor-depositing aluminum or the like may be employed. Gas barrier properties can thereby be enhanced.

The channel unit 83 is sandwiched by the sheet 82A and the sheet 82B, at the end portion 85D of the peripheral area 85. The channel unit 83 and the sheet 82A are welded together at the end portion 85D of the peripheral area 85. Similarly, the channel unit 83 and the sheet 82B are welded together at the end portion 85D of the peripheral area 85. The end portion 85D of the peripheral area 85 is thus a junction with the channel unit 83. The channel unit 83 is provided with a welding part 86. The sheet 82A and the sheet 82B are each welded to the welding part 86 in a state where the welding part 86 is sandwiched by the sheet 82A and the sheet 82B. The ink pack 82 functions as a bag that houses ink as a result of the sheet 82A, the sheet 82B and the channel unit 83 being joined together.

Figure 5:
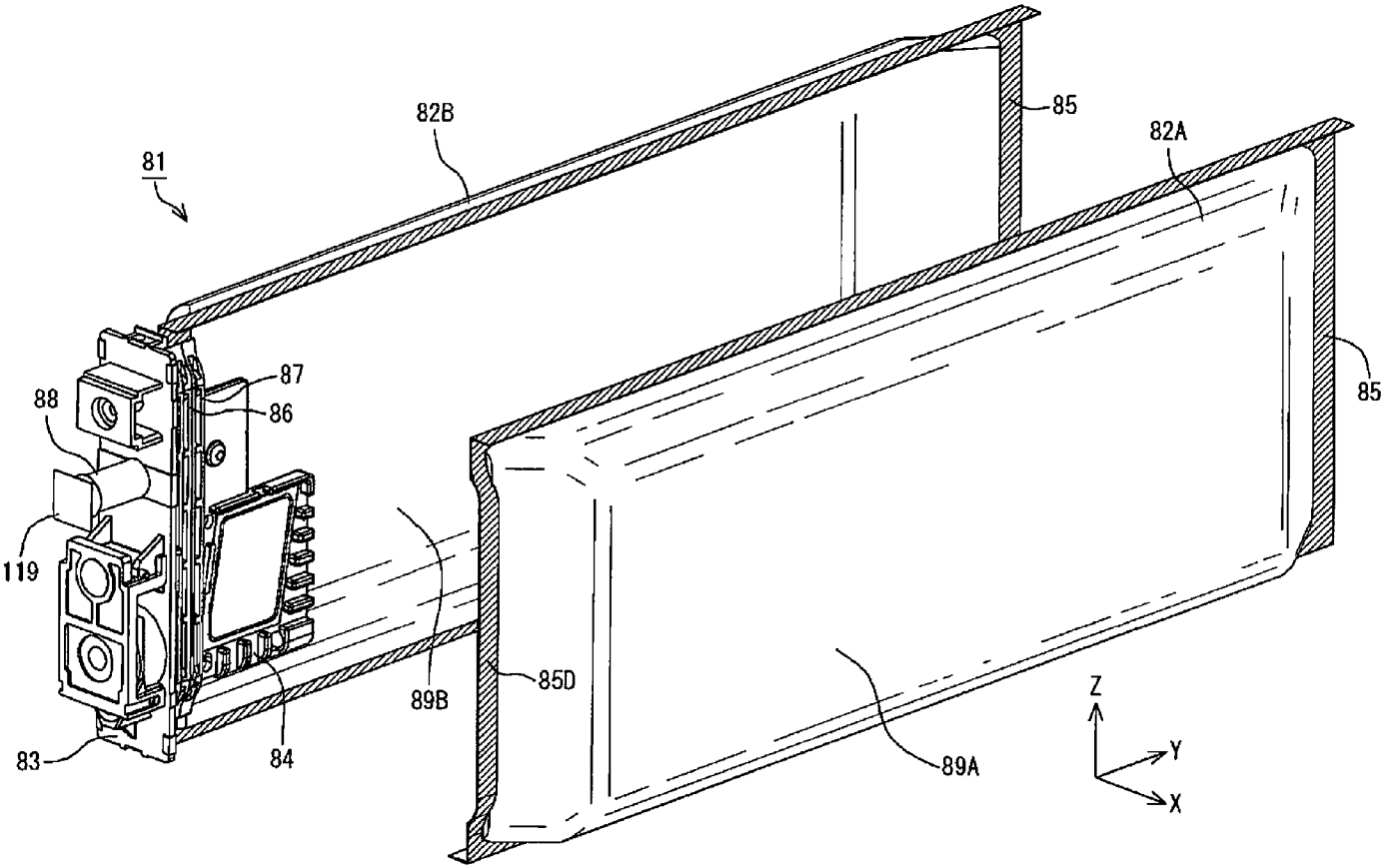
FIG. 5 is an exploded perspective view showing a pack unit in one embodiment.

The filter unit 84 is housed inside the ink pack 82. The filter unit 84 passes ink that is inside the ink pack 82 through a filter which will be discussed later, and supplied the filtered ink to the channel unit 83. The filter unit 84 is housed inside the ink pack 82 in a state of being joined to the channel unit 83, as shown in FIG. 5. The filter unit 84 is provided with a welding part 87, as shown in FIG. 4. The sheet 82A and the sheet 82B are each welded to the welding part 87, in a state where the welding part 87 is sandwiched by the sheet 82A and the sheet 82B.

The filter unit 84 is sandwiched by the sheet 82A and the sheet 82B at the end portion 85D of the peripheral area 85. The filter unit 84 and the sheet 82A are welded together at the end portion 85D of the peripheral area 85. Similarly, the filter unit 84 and the sheet 82B are welded together at the end portion 85D of the peripheral area 85. The end portion 85D of the peripheral area 85 is thus a junction with the filter unit 84.

In the present embodiment, the welding part 86 and the welding part 87 are sandwiched by the sheet 82A and the sheet 82B, in a state where the channel unit 83 and the filter unit 84 are joined together, as shown in FIG. 5. The sheet 82A and the sheet 82B are each welded to both the welding part 86 and the welding part 87. Note that the sheet 82A has a surface 89A along the YZ plane. Also, the sheet 82B has a surface 89B along the YZ plane. The surface 89A and the surface 89B are each one of a plurality of surfaces constituting the ink pack 82. Also, the surface 89A and the surface 89B each have the largest area of the plurality of surfaces constituting the ink pack 82.

A supply pipe 88, which is an example of a liquid outlet, is provided in the channel unit 83. The inside and outside of the ink pack 82 communicate via the supply pipe 88. The supply pipe 88 is closed by a film 119, in a state before the cartridge 49 is mounted in the holder 53. The sealed state is thereby preserved inside the ink pack 82. The supply pipe 88 is exposed via an opening 91 provided in the third case 71C shown in FIG. 3. Also, a recessed part 93 is provided in the third case 71C. The substrate 75 is provided inside the recessed part 93.

The cartridge 49 having the above configuration is inserted into the holder 53 in the −Y-axis direction, as shown in FIG. 1. A hollow needle which is not illustrated is provided inside the holder 53. The hollow needle inside the holder 53 communicates with the ink supply tube 57. The hollow needle inside the holder 53 is inserted into the supply pipe 88 of the channel unit 83 when the cartridge 49 is mounted in the holder 53 (FIG. 4). The film 119 is torn by the hollow needle inserted into the supply pipe 88, and communication is established between the inside and outside of the ink pack 82 via the hollow needle. Communication is thereby established between the inside of the ink pack 82 and the ink supply tube 57 (FIG. 1), and the ink inside the ink pack 82 can be supplied to the ink supply tube 57.

Figure 6:
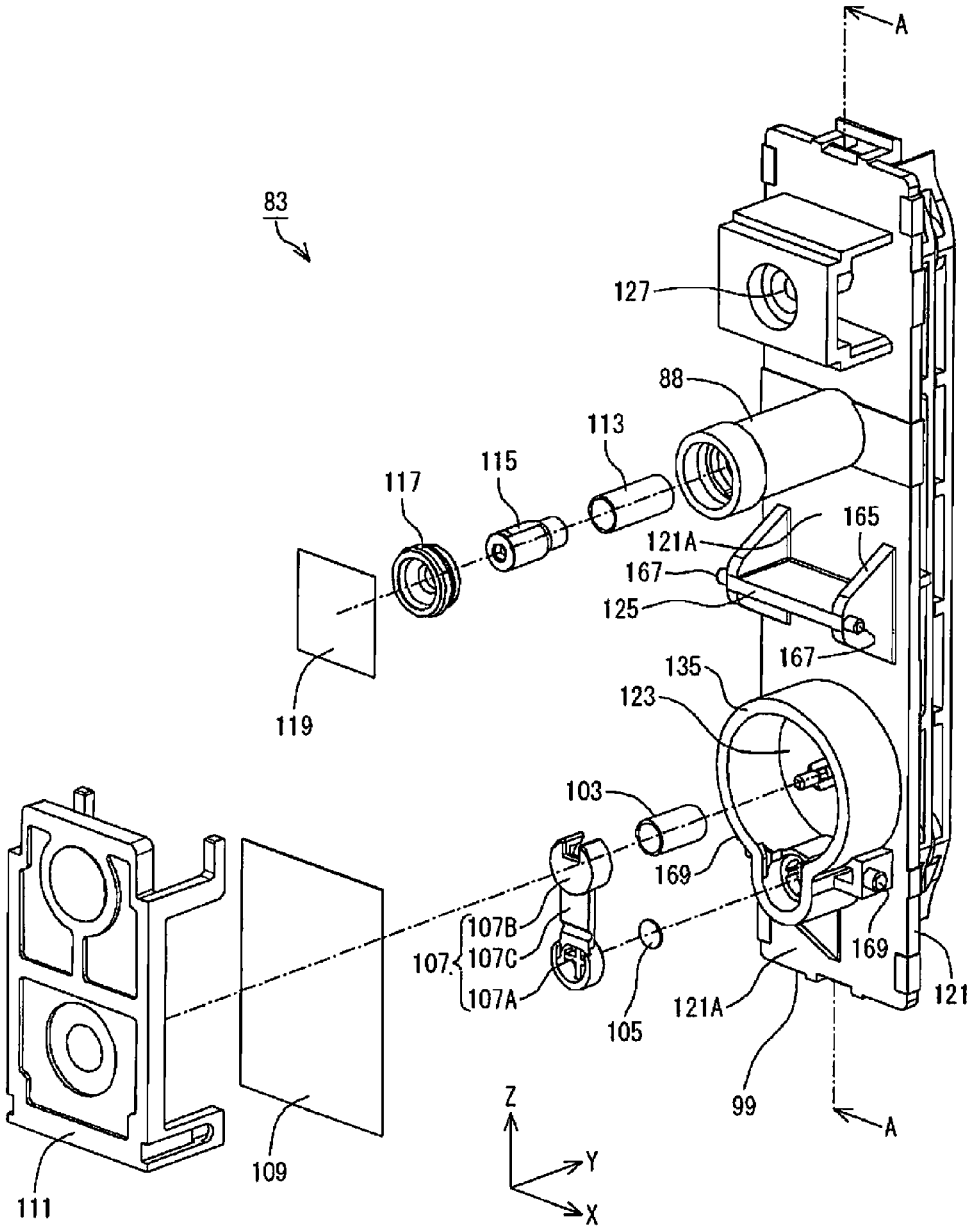
FIG. 6 is an exploded perspective view showing a schematic configuration of a channel unit in one embodiment.

The channel unit 83 will now be described in detail. The channel unit 83 has a first channel member 99, a spring 103, a check valve 105, a pressure-receiving member 107, a film 109 and a lever 111, as shown in FIG. 6. Also, the channel unit 83 has a spring 113, a plug 115, a packing 117, and a film 119. The first channel member 99 has a base 121, a cavity 123, a stopper 125, a supply pipe 88, and an injection port 127. The base 121 has a surface 121A facing in the opposite direction to the ink pack 82 side (FIG. 4). The cavity 123, the stopper 125, the supply pipe 88 and the injection port 127 are provided on the surface 121A so as to project from the surface 121A in the opposite direction to the ink pack 82 side.

The spring 103, the check valve 105 and the pressure-receiving member 107 are housed inside the cavity 123. Also, the cavity 123 is closed by the film 109 in a state where the spring 103, check valve 105 and the pressure-receiving member 107 are housed therein. The lever 111 overlaps the cavity 123 with the film 109 therebetween. The spring 113, the plug 115 and the packing 117 are housed within the supply pipe 88. The supply pipe 88 is closed by the film 119 in a state where the spring 113, the plug 115 and the packing 117 are housed therein. Note that in the present embodiment, a compression coil spring is respectively employed as the spring 103 and the spring 113.

Figure 7:
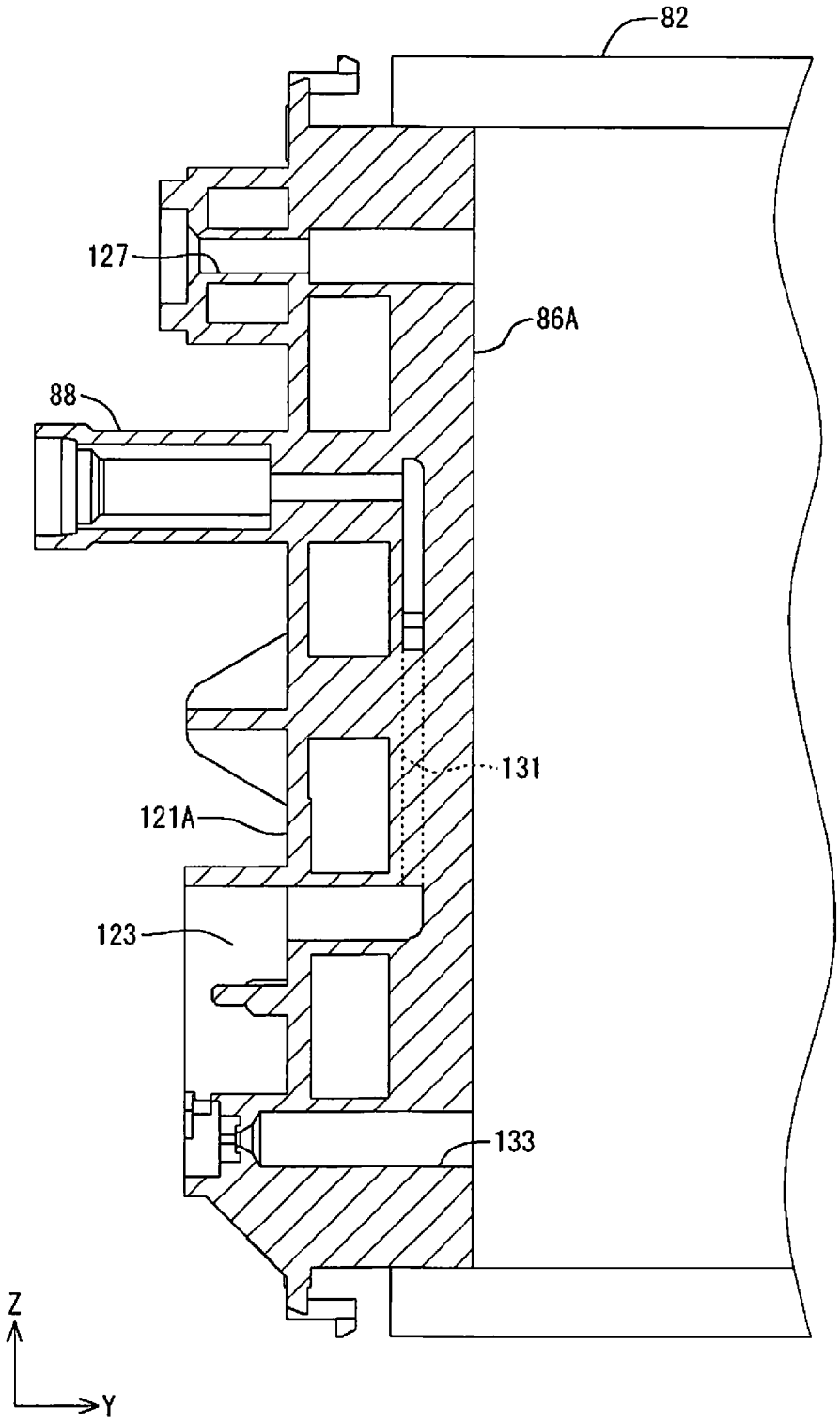
FIG. 7 is a cross-sectional view along an A-A line in FIG. 6.

The cavity 123 and the supply pipe 88 communicate with each other via a channel 131 provided on the ink pack 82 side of the surface 121A, as shown in FIG. 7, which is a cross-sectional view along an A-A line in FIG. 6. Note that illustration of the filter unit 84 is omitted in FIG. 7. Also, the cavity 123 and the inside of the ink pack 82 communicate through a channel 133 provided on the ink pack 82 side of the surface 121A. The injection port 127 leads into the ink pack 82. The injection port 127 is closed after ink has been injected into the ink pack 82.

The ink inside the ink pack 82 flows from the channel 133 to the supply pipe 88 via the cavity 123 and the channel 131. In other words, the path from the channel 133 to the supply pipe 88 via the cavity 123 and the channel 131 constitutes the path of ink that is drawn from inside the ink pack 82 to outside the ink pack 82 via the supply pipe 88.

Figure 8:
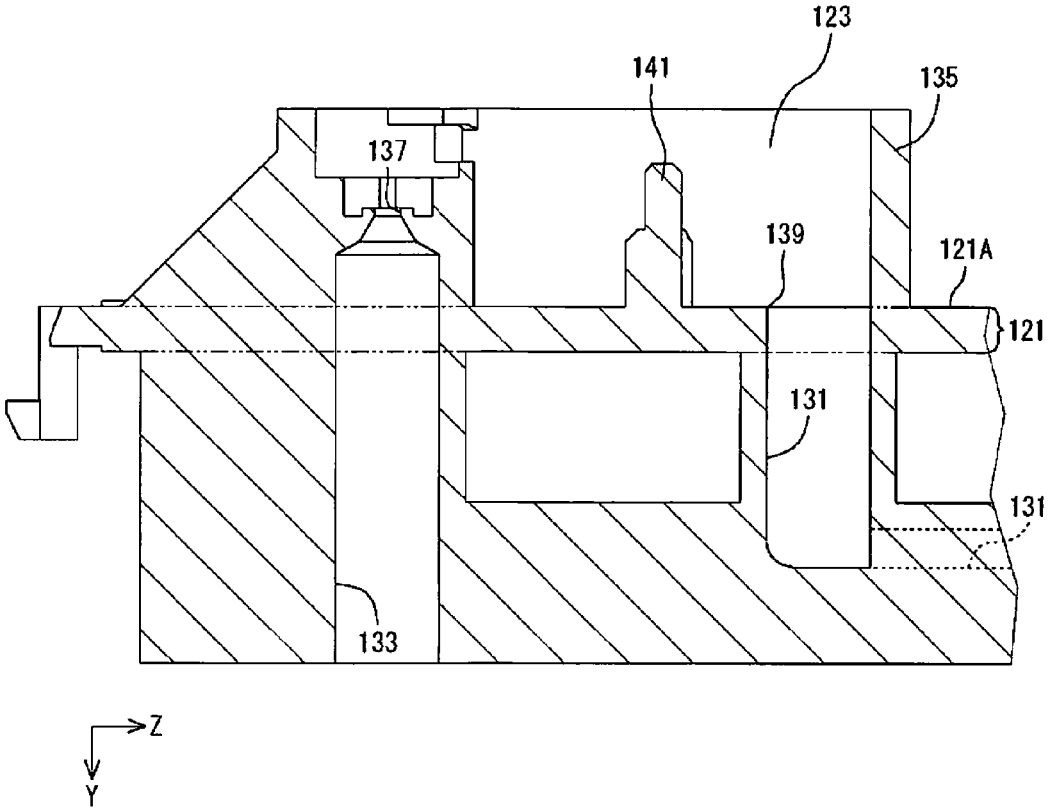
FIG. 8 is an enlarged view of a cavity in FIG. 7.

The cavity 123 is surrounded by a side wall 135 that projects from the surface 121A in the opposite direction to the channel 131 side (ink pack 82 side), as shown in FIG. 8, which is an enlarged view of the cavity 123 shown in FIG. 7. The cavity 123 forms a recessed shape that is recessed toward the surface 121A side in the area surrounded by the side wall 135. An inflow port 137 and an outflow port 139 are provided inside the cavity 123. The ink inside the ink pack 82 flows in via the channel 133 to the cavity 123 through the inflow port 137. Also, the ink inside the cavity 123 flows out through the outflow port 139 to the supply pipe 88 via the channel 131 (FIG. 7).

Figure 9:
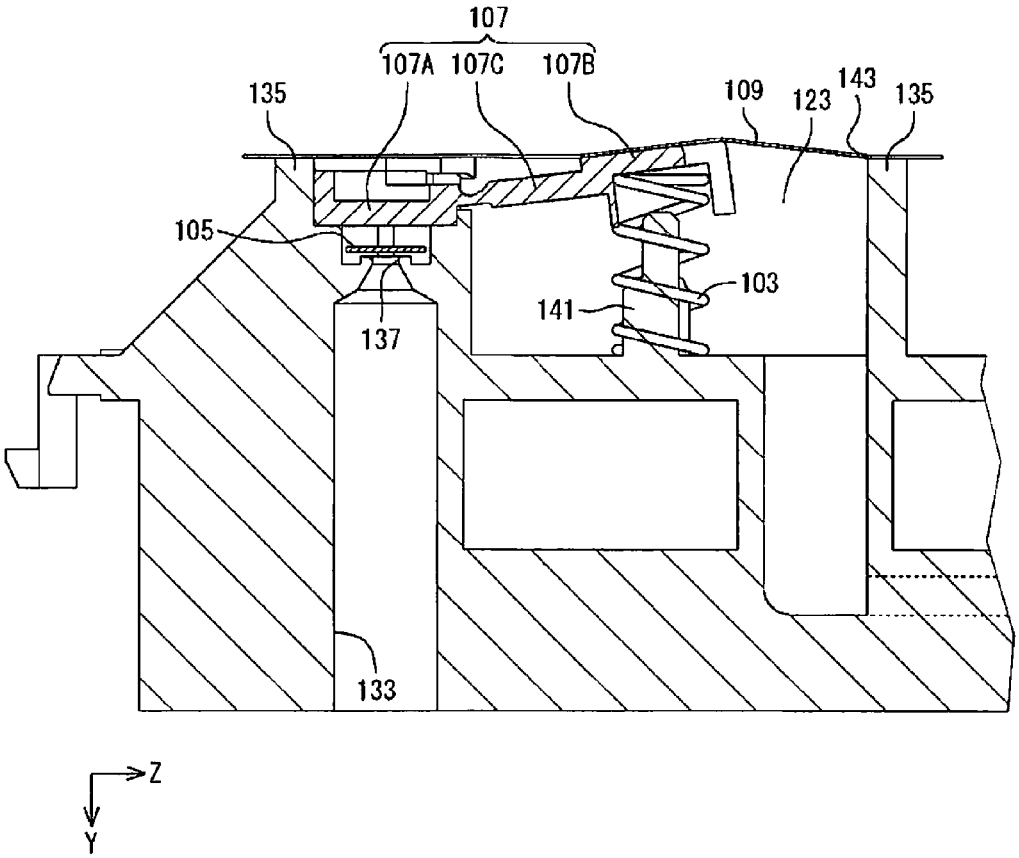
FIG. 9 is an enlarged view showing a region of the cavity in FIG. 7.

A raised part 141 that is raised from the surface 121A in the opposite direction to the base 121 side is provided on the bottom of the cavity 123, as shown in FIG. 8. The end portion of the raised part 141 on the opposite side to the base 121 side is located inside the cavity 123. The spring 103 is fitted onto the raised part 141, as shown in FIG. 9. The spring 103, in a state of being fitted onto the raised part 141, projects further on the opposite side to the base 121 side than the raised part 141.

The check valve 105 is provided on the cavity 123 side of the inflow port 137. The check valve 105 suppresses the flow of ink back into the inflow port 137 from inside the cavity 123. The pressure-receiving member 107 is provided further on the cavity 123 side (downstream side of the ink flow) than the check valve 105. The pressure-receiving member 107 has a supported part 107A and a spring bearing 107B, as shown in FIG. 6. The supported part 107A and the spring bearing 107B are coupled to each other via an arm part 107C.

In the present embodiment, the supported part 107A of the pressure-receiving member 107 is supported by the side wall 135, as shown in FIG. 9. Note that a circulation hole which is not illustrated is provided in the supported part 107A. The ink that flows to the supported part 107A side through the inflow port 137 can circulate on the downstream side of the supported part 107A via the circulation hole in the supported part 107A.

The spring bearing 107B extends to a central portion of the cavity 123 as a result of the arm part 107C. The spring bearing 107B thereby faces the raised part 141. The spring 103 is sandwiched by the bottom of the cavity 123 and the spring bearing 107B. The spring bearing 107B is thereby biased in the opposite direction to the base 121 side by the spring 103.

An opening 143 of the cavity 123 is sealed by the film 109. The inside and outside of the cavity 123 are thereby separated by the film 109. The film 109 is joined to the side wall 135. The opening 143 of the cavity 123 is thereby sealed with the film 109. Note that, in the present embodiment, the film 109 is welded to the side wall 135. In the state where the opening 143 of the cavity 123 is sealed with the film 109, biasing of the pressure-receiving member 107 by the spring 103 is also exerted on the film 109. In other words, the film 109 is biased in the opposite direction to the base 121 side by the spring 103 via the pressure-receiving member 107.

Figure 10:
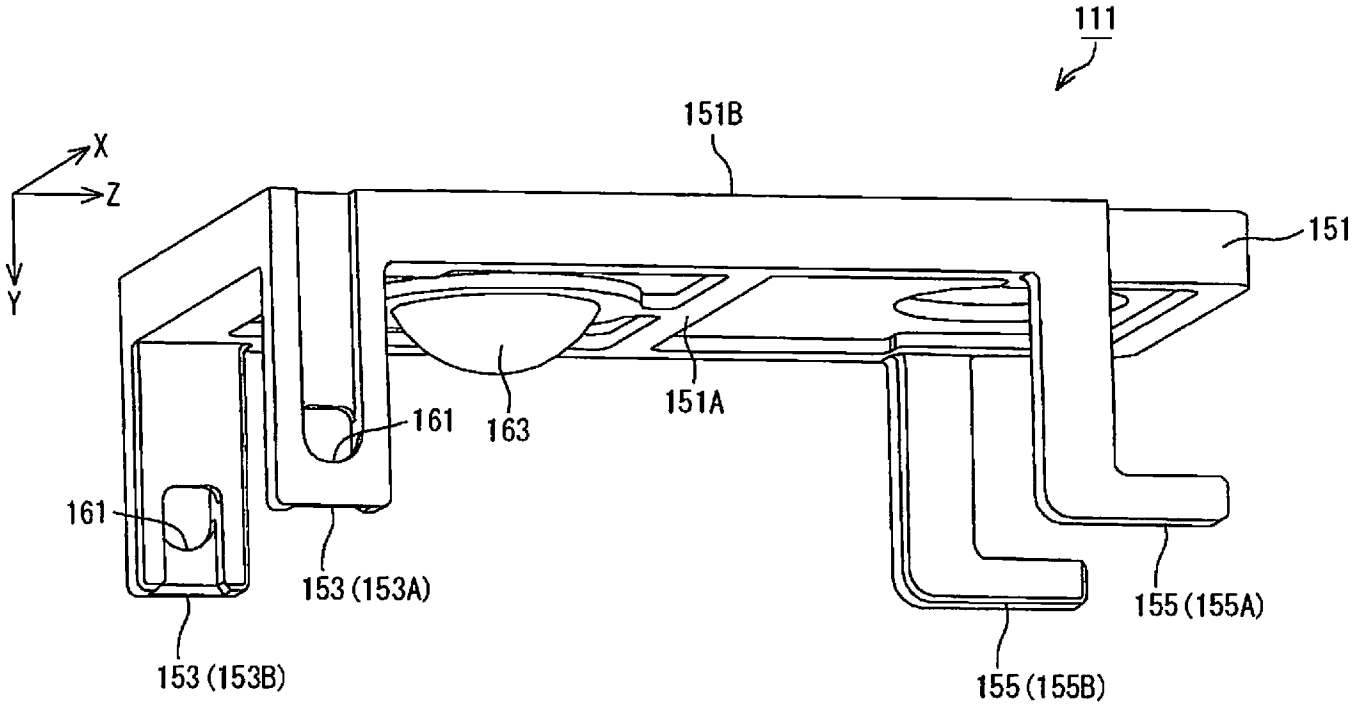
FIG. 10 is an external view showing a lever in one embodiment.

The lever 111 has a base 151, two shaft bearings 153 and two hooks 155, as shown in FIG. 10. The base 151 has tabular appearance, and has a first surface 151A and a second surface 151B that is the opposite surface to the first surface 151A. The two shaft bearings 153 and the two hooks 155 each project from the first surface 151A of the base 151 so as to be raised in the opposite direction to the base 151 side. The two shaft bearings 153 are provided at one end of the base 151 in the Z-axis direction. The two shaft bearings 153 are arranged side by side in the X-axis direction with a gap therebetween. Hereinafter, in the case of identifying the two shaft bearings 153 from each other, the two shaft bearings 153 will be respectively denoted as a shaft bearing 153A and a shaft bearing 153B.

The two hooks 155 are provided at the other end of the base 151 in the Z-axis direction. The two hooks 155 are arranged side by side along the X-axis with a gap therebetween. Hereinafter, in the case of identifying the two hooks 155 from each other, the two hooks 155 will be respectively denoted as a hook 155A and a hook 155B. The hook 155A and the shaft bearing 153A are aligned along the Z-axis. Also, the hook 155B and the shaft bearing 153B are aligned along the Z-axis. The end portions of the two hooks 155 on the opposite side to the base 151 side are each bent in an L shape (hook shape) in the opposite direction to the shaft bearing 153 side. Shaft bearing holes 161 that pass through the shaft bearings 153 in the X-axis direction are respectively provided in end portions of the two shaft bearings 153 on the opposite side to the base 151 side. Also, a protrusion 163 that is raised from the first surface 151A in the opposite direction to the base 151 side is provided on the first surface 151A of the base 151. The protrusion 163 is located between the shaft bearings 153 and the hooks 155 in the Z-axis direction.

The stopper 125 has a support part 165 and two shafts 167, as shown in FIG. 6. The support part 165 projects from the surface 121A of the base 121 in the opposite direction to the base 121 side. The two shafts 167 are each provided in the support part 165. The two shafts 167 are each provided in a state of being suspended above the surface 121A. In other words, a gap is provided between the two shafts 167 and surface 121A. The two shafts 167 extend from the support part 165 away from each other along the X-axis.

Two shafts 169 are provided on the outer side of the side wall 135 constituting the cavity 123. The two shafts 169 project in opposite directions to each other with the cavity 123 sandwiched therebetween along the X-axis. The two shafts 169 are each provided in a state of being suspended above the surface 121A. In other words, a gap is provided between the two shafts 169 and surface 121A.

Figure 11:
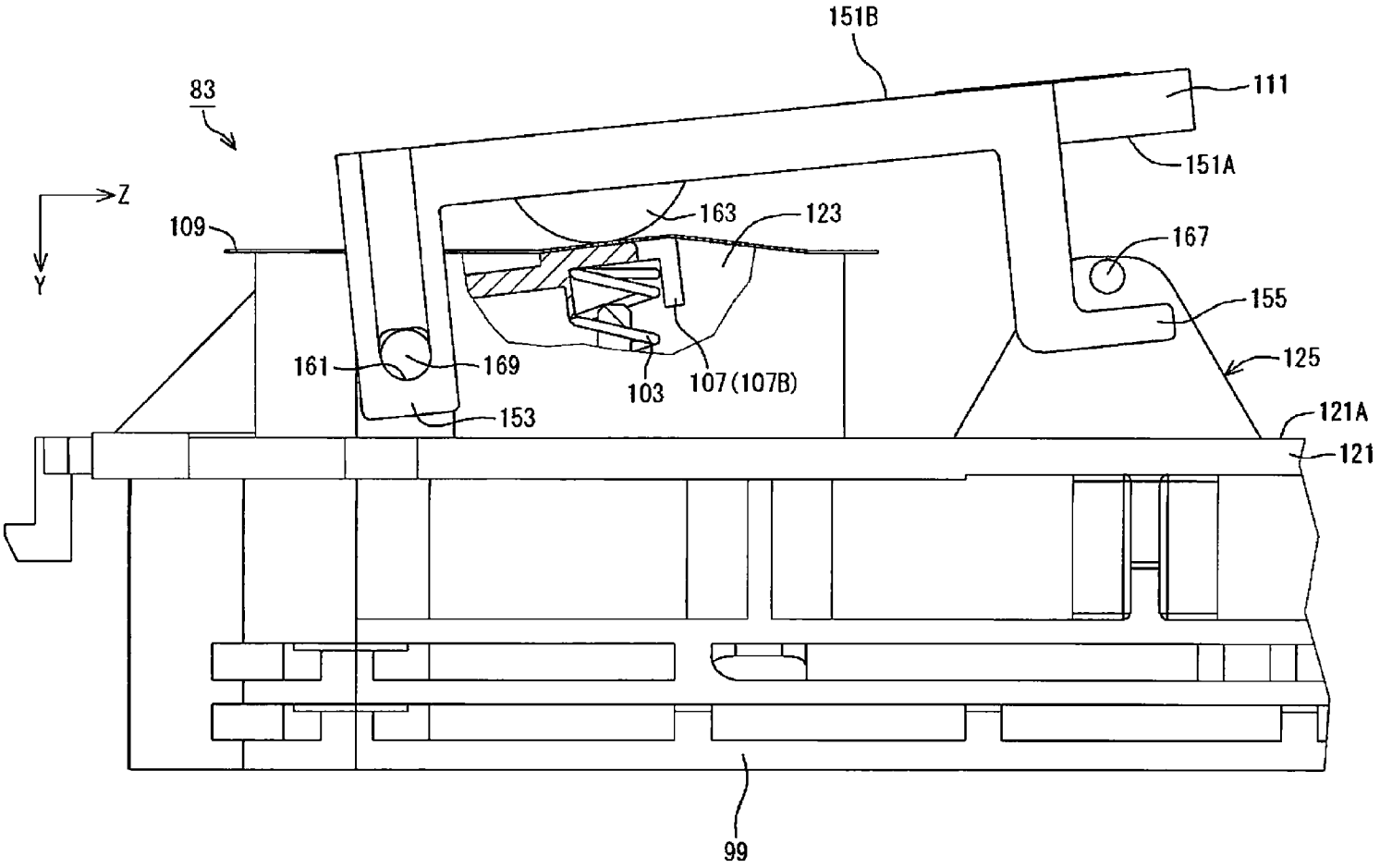
FIG. 11 is an external view showing a channel unit in one embodiment.

In the channel unit 83, the lever 111 is attached to the first channel member 99, as shown in FIG. 11. The first surface 151A of the lever 111 is oriented toward the surface 121A of the base 121, in a state where the lever 111 is attached to the first channel member 99. Also, the two shafts 169 of the first channel member 99 are fitted into the two shaft bearing holes 161 of the lever 111, in a state where the hooks 155 of the lever 111 are oriented toward the stopper 125 side. The two hooks 155 are each inserted between the surface 121A and the shafts 167. The lever 111 is configured so as to be turnable with the two shafts 169 as the fulcrum, in a state where the lever 111 is attached to the first channel member 99. The turning of the lever 111 is regulated by the two hooks 155. The turning range of the lever 111 is a range between the position at which the hooks 155 abut against the shafts 167 and the position at which the hooks 155 abut against the surface 121A.

The protrusion 163 of the lever 111 faces the spring bearing 107B of the pressure-receiving member 107 across the film 109, in a state where the lever 111 is attached to the first channel member 99. As aforementioned, the film 109 is biased in the opposite direction to the base 121 side by the spring 103 via the pressure-receiving member 107. The lever 111 is thus biased, via the protrusion 163, in a direction that opens the angle between the first surface 151A and the surface 121A, that is, in a direction in which the lever 111 moves away from the base 121.

Figure 13:
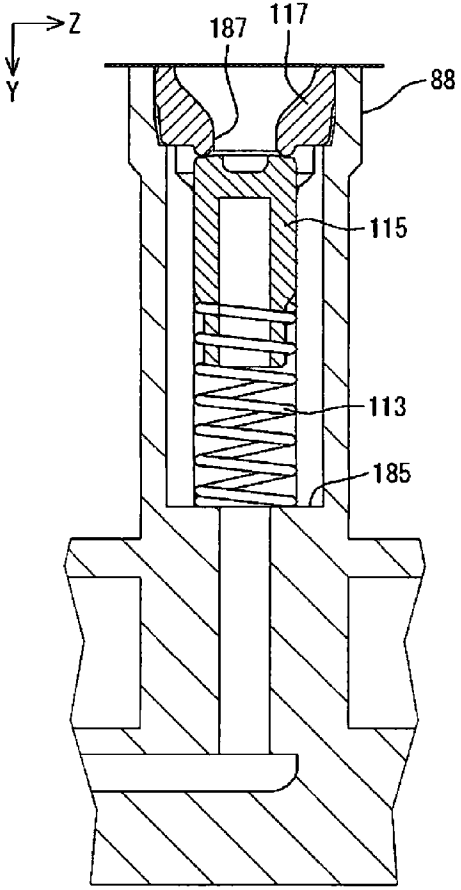
FIG. 13 is an enlarged view showing a region of the supply pipe in FIG. 7.
Figure 12:
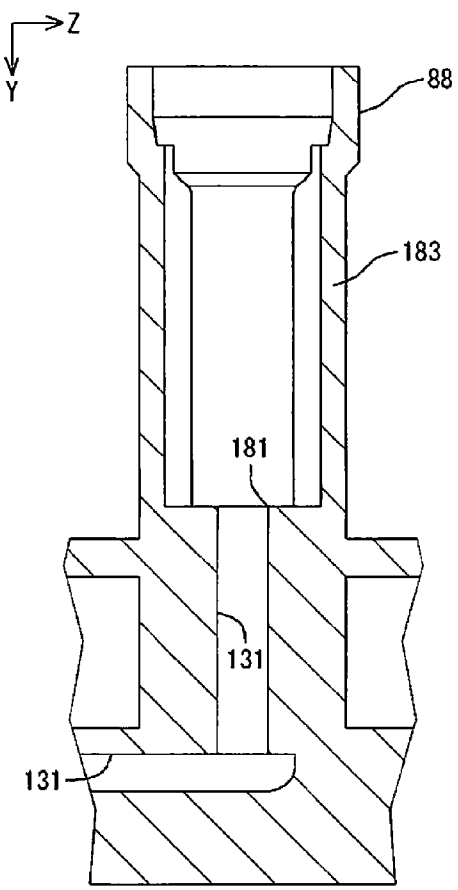
FIG. 12 is an enlarged view of a supply pipe in FIG. 7.

The supply pipe 88 has a side wall 183 that surrounds a supply port 181, which is the end of the channel 131, as shown in FIG. 12. The side wall 183 projects from the surface 121A in the opposite direction to the base 121 side. The supply port 181 is provided within the area of the supply pipe 88 surrounded by the side wall 183. The ink inside the channel 131 is supplied via the supply port 181 to within the supply pipe 88, that is, within the area surrounded by the side wall 183. The spring 113, the plug 115 and the packing 117 are housed inside the supply pipe 88, as shown in FIG. 13. The spring 113 is sandwiched by a bottom 185 of the supply pipe 88 and the plug 115. The plug 115 is sandwiched by the spring 113 and the packing 117. The plug 115 is thus biased toward the packing 117 side by the spring 113.

The packing 117 is constituted by an elastic body such as rubber or an elastomer, for example. The packing 117 is press-fitted into the supply pipe 88. An opening 187 is provided in the packing 117. The plug 115 is biased toward the packing 117 side, in a state of overlapping the opening 187 of the packing 117. The opening 187 of the packing 117 is thus closed by the plug 115. A gap is maintained between the plug 115 and the supply pipe 88. Also, a gap is maintained also between the spring 113 and the supply pipe 88. The plug 115 and the spring 113 can thus be respectively displaced in the Y-axis direction within the supply pipe 88.

Figure 14:
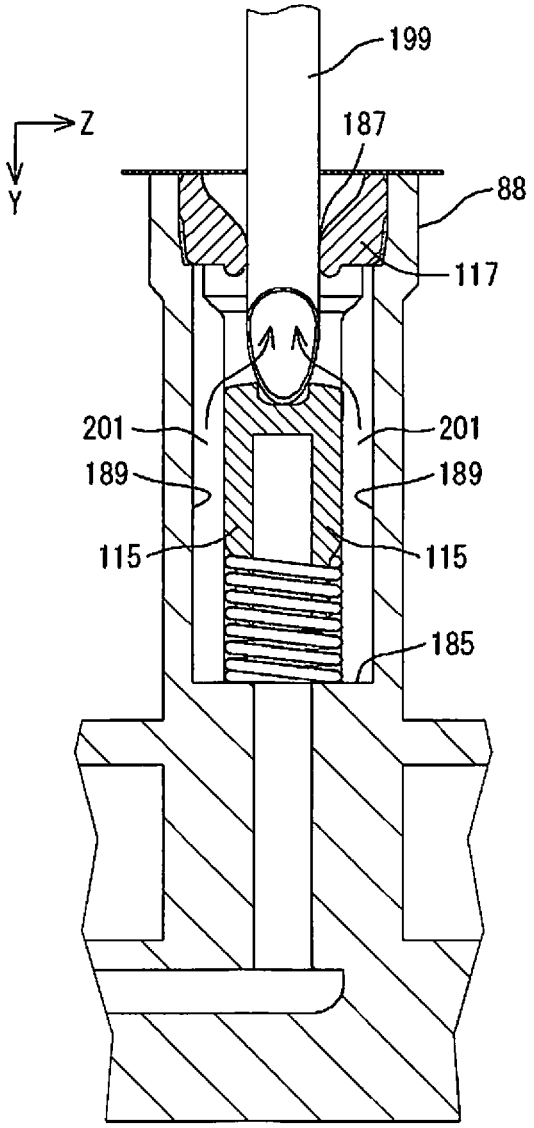
FIG. 14 is an enlarged view showing a region of the supply pipe in FIG. 7.

A hollow needle 199, which is an example of a liquid inlet, is inserted into the opening 187 of the packing 117 when mounting the cartridge 49 in the holder 53 (FIG. 1), as shown in FIG. 14. At this point, the plug 115 is pushed by the hollow needle 199 and displaced toward the bottom 185 side. Ink can thereby be supplied from a channel 201 surrounded by a groove 189 and the plug 115 to the ink supply tube 57 (FIG. 1) via the hollow needle 199, as shown by the arrows in the diagram. Note that the hollow needle 199 is provided inside the holder 53.

Figure 15:
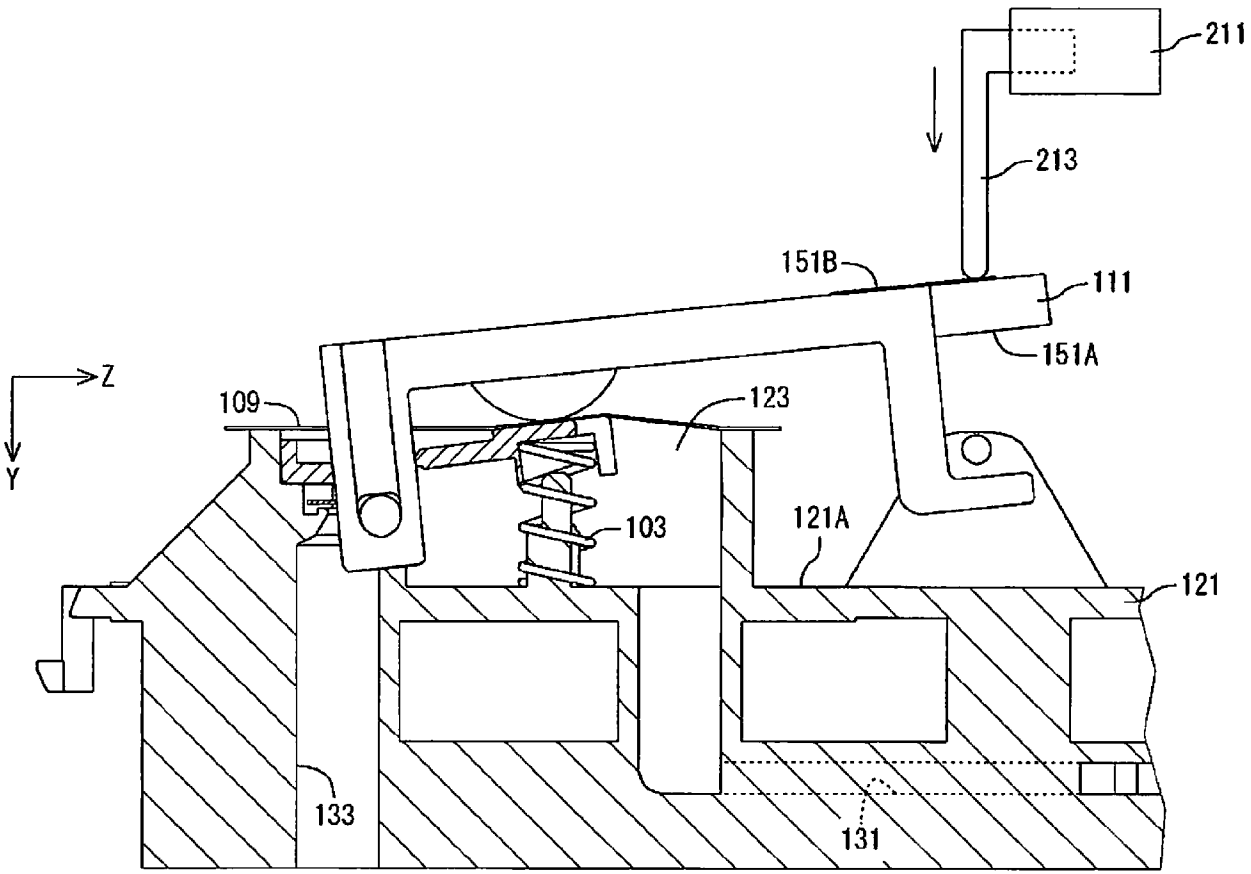
FIG. 15 is a diagram illustrating a residual quantity detection method in one embodiment.

With the channel unit 83 having the above configuration, the lever 111 is displaced within a turnable range according to the amount of ink inside the cavity 123. In the present embodiment, the residual amount of the ink inside the cartridge 49 is detected, based on the displacement of the lever 111. In the present embodiment, the residual amount of the ink inside the cartridge 49 is detected by detecting the displacement of the lever 111 with an optical sensor 211, as shown in FIG. 15. Note that the displacement of the lever 111 is detected via a detection rod 213. In the present embodiment, the detection rod 213 and the optical sensor 211 are provided in the printer 3.

The detection rod 213 abuts against the second surface 151B of the lever 111, as shown in FIG. 15. The detection rod 213 is biased in the direction of the arrow in the diagram via a biasing mechanism which is not illustrated. The direction of the biasing force that is provided to the detection rod 213 is in the opposite direction to the direction of the biasing force of the spring 103. The biasing force provided to the detection rod 213 acts on the lever 111 via the detection rod 213. Thus, the lever 111 remains stationary in a state where the biasing force from the detection rod 213 and the biasing force from the spring 103 are balanced. In this state, the position of the optical sensor 211 and the detection rod 213 is set to the position at which the detection rod 213 is detected by the optical sensor 211.

When ink is suctioned from the supply pipe 88, the amount of ink inside the cavity 123 decreases. Here, in the present embodiment, the cross-sectional area of the channel 131 is larger than the cross-sectional area of the inflow port 137. The resistance of the ink flowing through the inflow port 137 of the channel 133 is thus stronger than resistance of the ink flowing through the channel 131. When ink is suctioned from the supply pipe 88, the pressure within the cavity 123 decreases (hereinafter, decompressed state).

Figure 16:
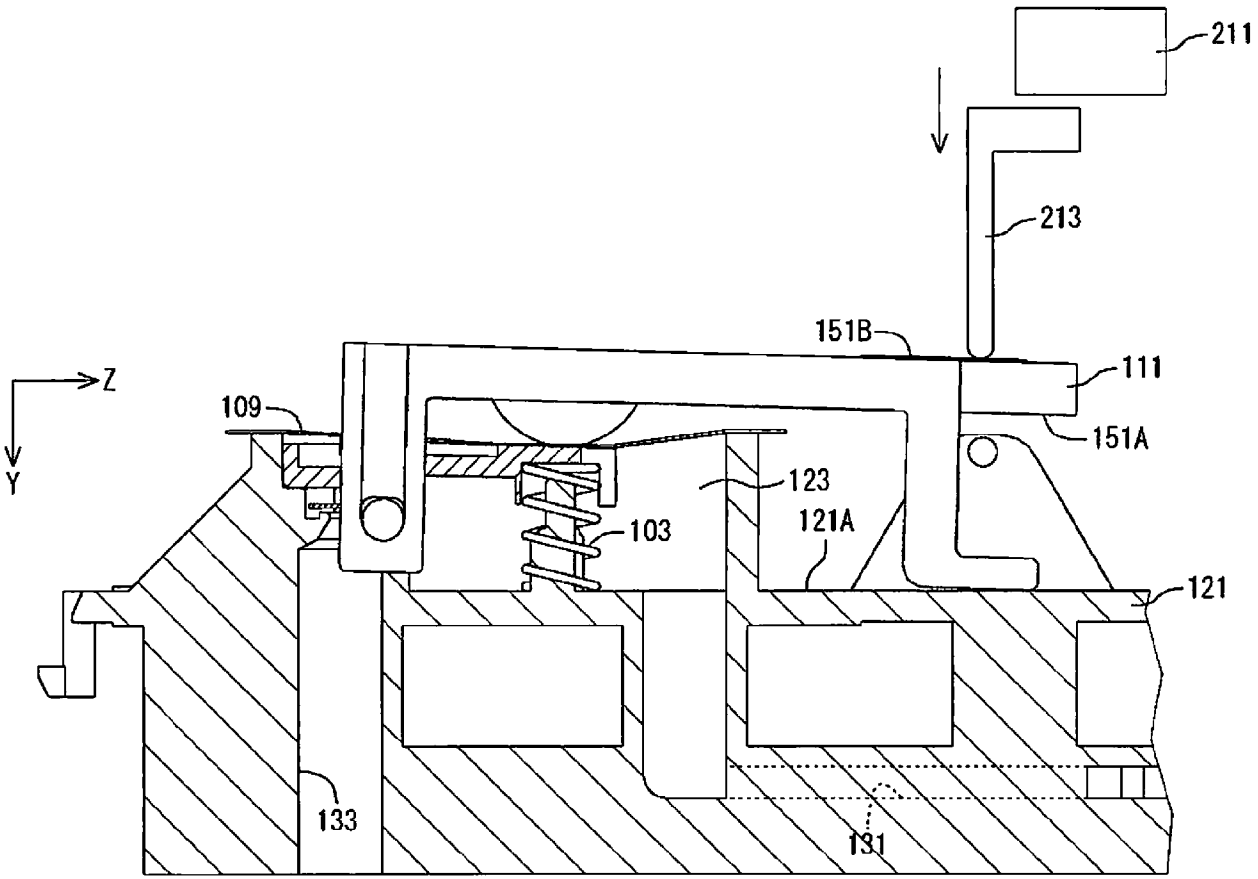
FIG. 16 is a diagram illustrating a residual amount detection method in one embodiment.

At this point, the spring 103 is compressed toward the surface 121A side from the film 109 side by the pressure within the cavity 123 in the decompressed state and the biasing force from the detection rod 213, as shown in FIG. 16. The film 109 thereby bends toward the surface 121A side, that is, toward the inner side of the cavity 123. As a result, the lever 111 is displaced in a direction that closes the angle between the first surface 151A and the surface 121A, that is, in the direction in which the lever 111 moves closer to the base 121. The position of the optical sensor 211 and the detection rod 213 is set to the position at which the detection rod 213 moves outside the detection range of the optical sensor 211 in this state.

Because ink is supplied in the cavity 123 over time as long as ink remains in the ink pack 82, the pressure within the cavity 123 is restored. In other words, the bend in the film 109 is restored when a predetermined time elapses after the ink is suctioned from the supply pipe 88. The lever 111 is thereby displaced in a direction that opens the angle between the first surface 151A and the surface 121A, that is, in the direction in which the lever 111 moves away from the base 121, as shown in FIG. 15. The detection rod 213 is thus again detected by the optical sensor 211 when a predetermined time elapses after the ink is suctioned from the supply pipe 88. This enables the ink remaining in the ink pack 82 to be detected.

On the other hand, in the case where there is not a sufficient amount of ink remaining in the ink pack 82 to restore the pressure within the cavity 123, the pressure within the cavity 123 is not restored even when the predetermined time has elapsed. The detection rod 213 is thus not detected again by the optical sensor 211, even when the predetermined time has elapsed after the detection rod 213 moves outside the detection range of the optical sensor 211. This enables the fact that there is no ink remaining in the ink pack 82 to be detected. As described above, the residual amount 82 of the ink inside the cartridge 49, that is, whether there is ink remaining inside the ink pack, is detected based on displacement of the lever 111.

Figure 17:
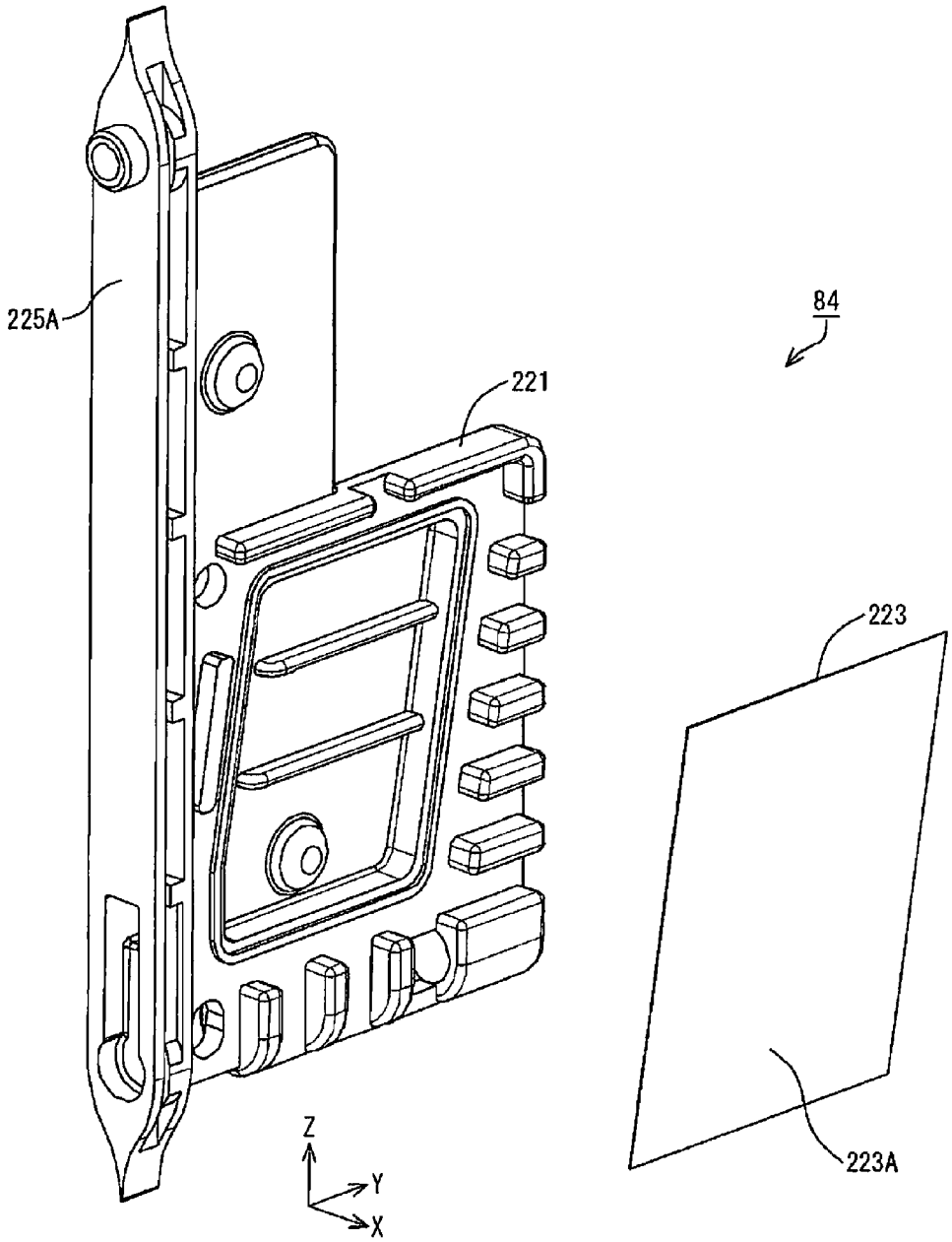
FIG. 17 is an exploded perspective view showing a filter unit in one embodiment.
Figure 18:
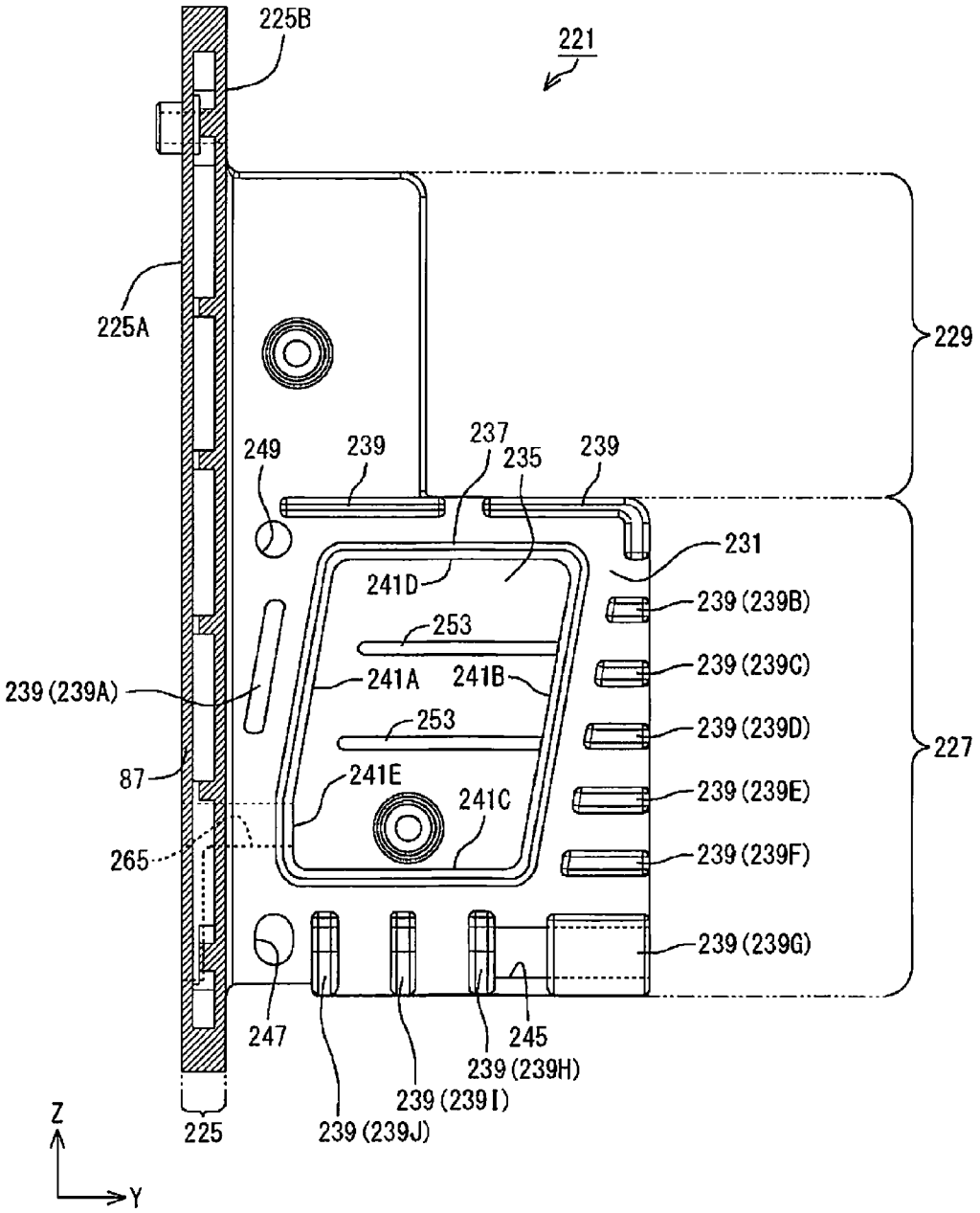
FIG. 18 is a side view showing a second channel member in one embodiment.

The filter unit 84 has a second channel member 221 and a filter 223, as shown in FIG. 17. The filter 223 has a largest surface 223A. The largest surface 223A extends along the YZ plane. The largest surface 223A is a surface having the largest area among the plurality of surfaces constituting the outer shape of the filter 223. The second channel member 221 is constituted by a plastic such as a synthetic resin. In the present embodiment, the second channel member 221 is formed by resin injection molding. In the following description, the second channel member 221 is divided into a base 225, a first region 227 and a second region 229, as shown in FIG. 18. The base 225 extends along the Z-axis. The outer periphery of the base 225 is set as the aforementioned welding part 87. In FIG. 18, the welding part 87 is hatched in order to make the configuration easy to see.

The base 225 has a surface 225A that is oriented toward the channel unit 83 (FIG. 4) side, and a surface 225B on the opposite side to the surface 225A. The surface 225A and the surface 225B each extend along the XZ plane. The first region 227 and the second region 229 each project from the surface 225B in the opposite direction to the channel unit 83 (FIG. 4) side, that is, toward the ink pack 82 side, as is shown in FIG. 18. The first region 227 has a tabular shape extending along the YZ plane. Also, the second region 229 has a tabular shape extending along the YZ plane. The first region 227 and the second region 229 are arranged side by side along the Z-axis. The base 225, the first region 227 and the second region 229 are connected to each other.

Figure 19:
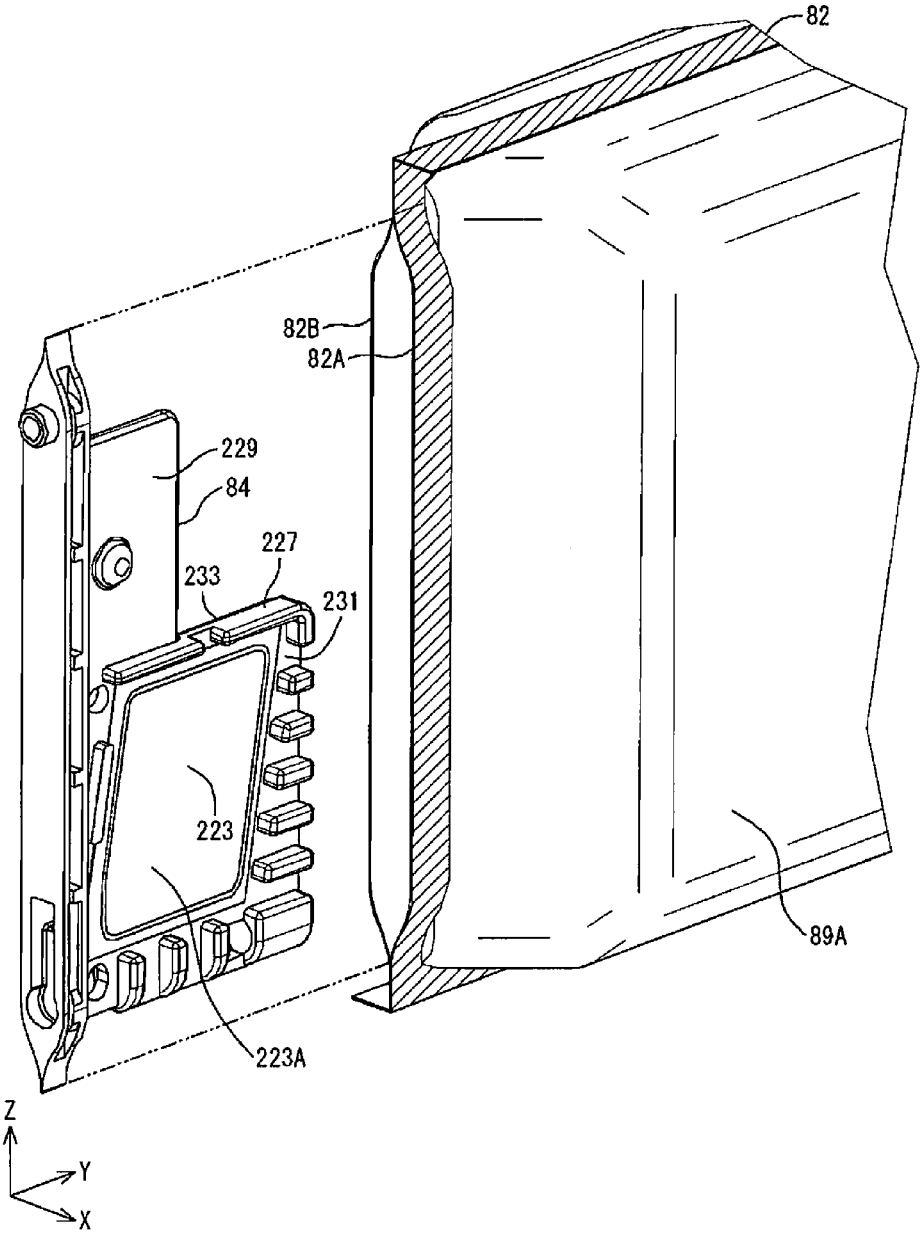
FIG. 19 is a perspective view showing a filter unit and an ink pack in one embodiment.
Figure 20:
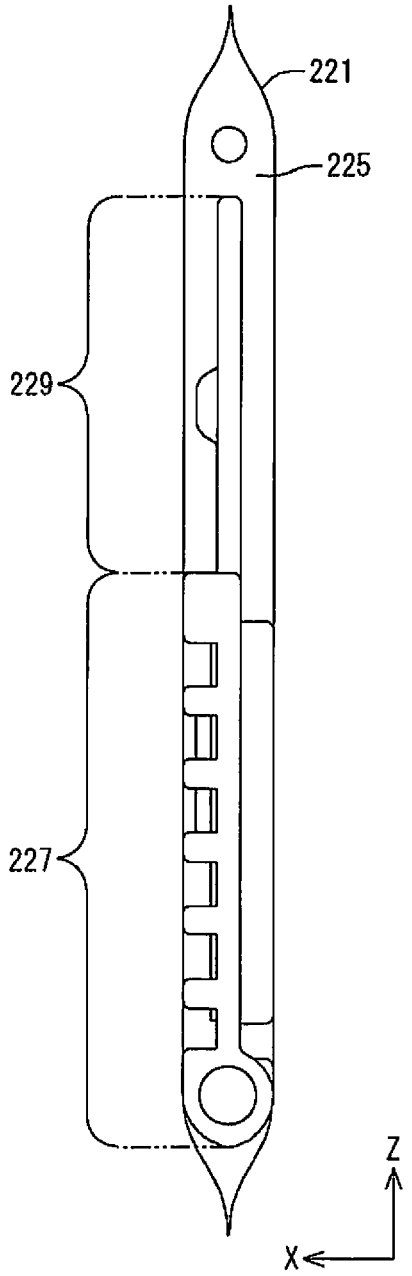
FIG. 20 is a rear view showing a second channel member in one embodiment.

The first region 227 and the second region 229 are housed inside the ink pack 82, as shown in FIG. 19. As aforementioned, in the ink pack 82, the surface 89A of the sheet 82A and the surface 89B of the sheet 82B (FIG. 5) extend along the YZ plane. In the present embodiment, the first and second regions 227 and 229 and the surfaces 89A and 89B thus each extend along the YZ plane. In other words, the first and second regions 227 and 229 and the surfaces 89A and 89B are substantially parallel to each other. Note that, in the second channel member 221, the first region 227 and the second region 229 are accommodated within an area that overlaps the base 225, when the XZ plane is viewed from the Y-axis, as shown in FIG. 20.

The first region 227 has a surface 231 that faces the sheet 82A in a state where the first region 227 is housed inside the ink pack 82, as shown in FIG. 19. Note that, in the first region 227, the surface on the opposite side to the surface 231, that is, the surface facing the surface 82B, is denoted as a surface 233. The surface 231 is shared by the first region 227 and the second region 229. In other words, in the second region 229, the surface facing the sheet 82A is continuous with the surface 231. Similarly, the surface 233 is shared by the first region 227 and the second region 229. In other words, in the second region 229, the surface facing the sheet 82B is continuous with the surface 233. The second region 229 can thus also be regarded as having a tabular shape continuous from the first region 227.

Figure 21:
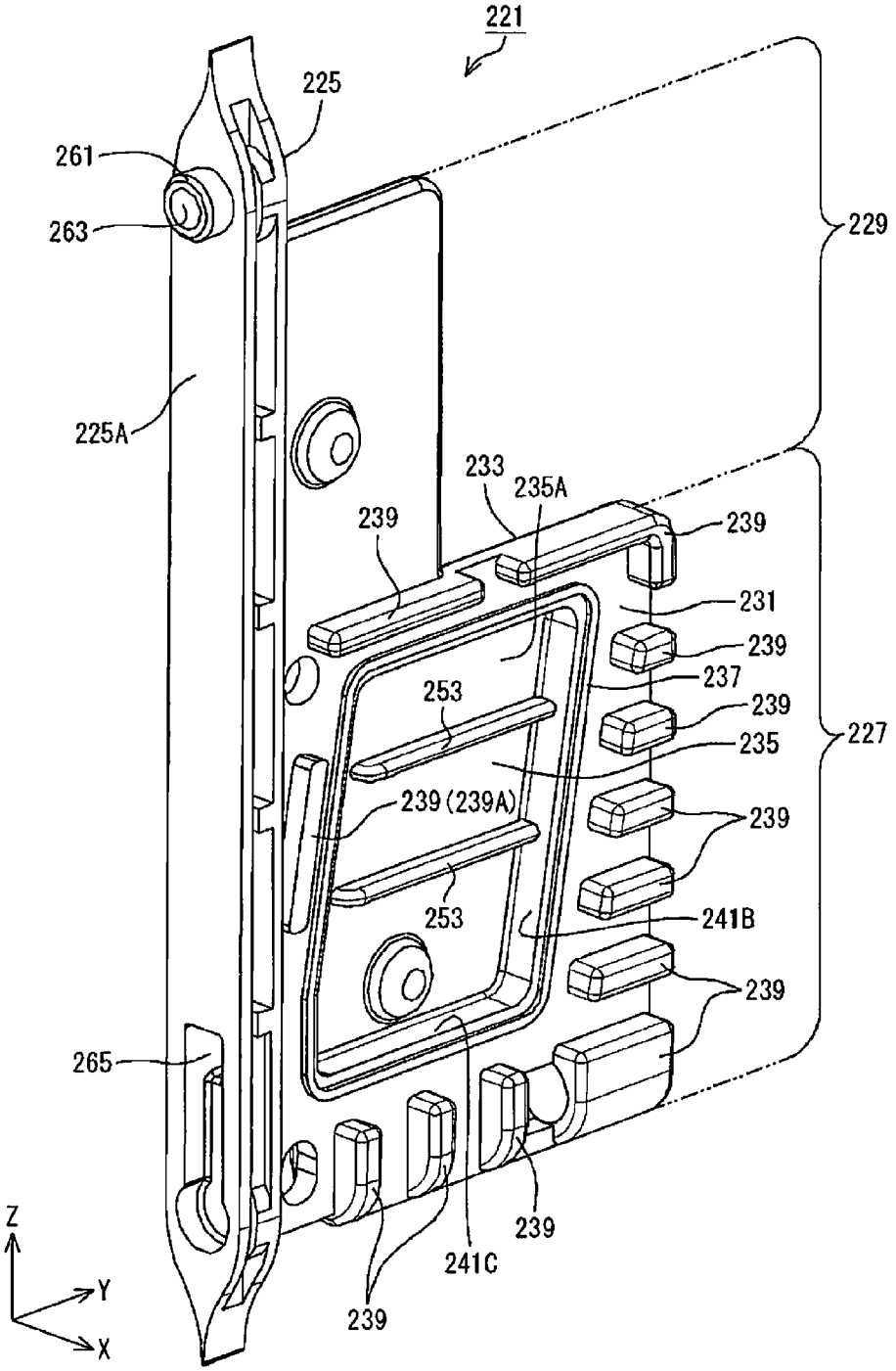
FIG. 21 is a perspective view showing a second channel member in one embodiment.

In the first region 227, a recessed part 235 is provided in the surface 231, as is shown in FIG. 21. The recessed part 235 is provided so as to be recessed toward the surface 233 from the surface 231, that is, so as to be recessed in the −X-axis direction from the surface 231. A bottom 235A of the recessed part 235 is thus located further on the surface 233 side than the surface 231. Also, in the surface 231, a bank part 237 surrounding the recessed part 235 is provided on the perimeter of the recessed part 235. The bank part 237 projects from the surface 231 in the X-axis direction, which is the direction on the opposite side to the surface 233 side, that is, toward the sheet 82A (FIG. 19). In the first region 227, a plurality of raised parts 239 are provided on the outer side of the area surrounded by the bank part 237.

The plurality of raised parts 239 each project from the surface 231 in the X-axis direction, which is the opposite direction to the surface 233 side, that is, toward the sheet 82A (FIG. 19) side. Also, the plurality of raised parts 239 each project further toward the sheet 82A (FIG. 19) side than the bank part 237. In other words, the height of each raised part 239 from the surface 231 is greater than the height of the bank part 237 from the surface 231. In the present embodiment, the plurality of raised parts 239 are annularly arranged side by side with gaps opened up therebetween. In the present embodiment, the plurality of raised parts 239 thus surround the perimeter of the recessed part 235. Also, in the present embodiment, a portion of the plurality of raised parts 239 are arranged side by side along the periphery of the first region 227.

The bank part 237 is provided along the border of the recessed part 235, as shown in FIG. 18. A raised part 239A, which is one of the plurality of raised parts 239, is located between the bank part 237 and the base 225. The five raised parts 239, among the plurality of raised parts 239, that are adjacent to a region 241B of the border of the recessed part 235 in the Y-axis direction are also respectively denoted as a raised part 239B, a raised part 239C, a raised part 239D, a raised part 239E, and a raised part 239F. The raised part 239B, the raised part 239C, the raised part 239D, the raised part 239E, and the raised part 239F are arranged side by side in this order in the direction from the second region 229 side to the first region 227 side, that is, in the −Z-axis direction.

The raised part 239, among the plurality of raised parts 239, that is adjacent to the raised part 239F in the −Z-axis direction is also denoted as a raised part 239G. The raised part 239G is located at the end of the first region 227 on the opposite side to the second region 229 side, and at the end of the first region 227 on the opposite side to the base 225 side. In other words, the raised part 239G is located in the corner of the first region 227 on the opposite side to the second region 229 side and on the opposite side to the base 225 side. The raised part 239G extends along the Y-axis.

Three raised parts 239 are arranged side by side along the Y-axis between the raised part 239G and the base 225 in the Y-axis direction. The three raised parts 239 that are located between the raised part 239G and the base 225 are respectively denoted as a raised part 239H, a raised part 239I, and a raised part 239J. The raised part 239H, the raised part 239I and the raised part 239J are arranged side by side in this order toward the base 225 side from the raised part 239G side. An opening 245 that passes through the first region 227 in the X-axis direction is provided between the raised part 239G and the raised part 239H. The opening 245 passes through the first region 227 between the surface 231 and the surface 233.

Also, an opening 247 that passes through the first region 227 in the X-axis direction is provided between the raised part 239J and the base 225. Furthermore, an opening 249 that passes through the first region 227 in the X-axis direction is provided further on the second region 229 side than the raised part 239A within the area of the first region 227. The opening 247 and the opening 249 each pass between the surface 231 and the surface 233 of the first region 227.

Figure 22:
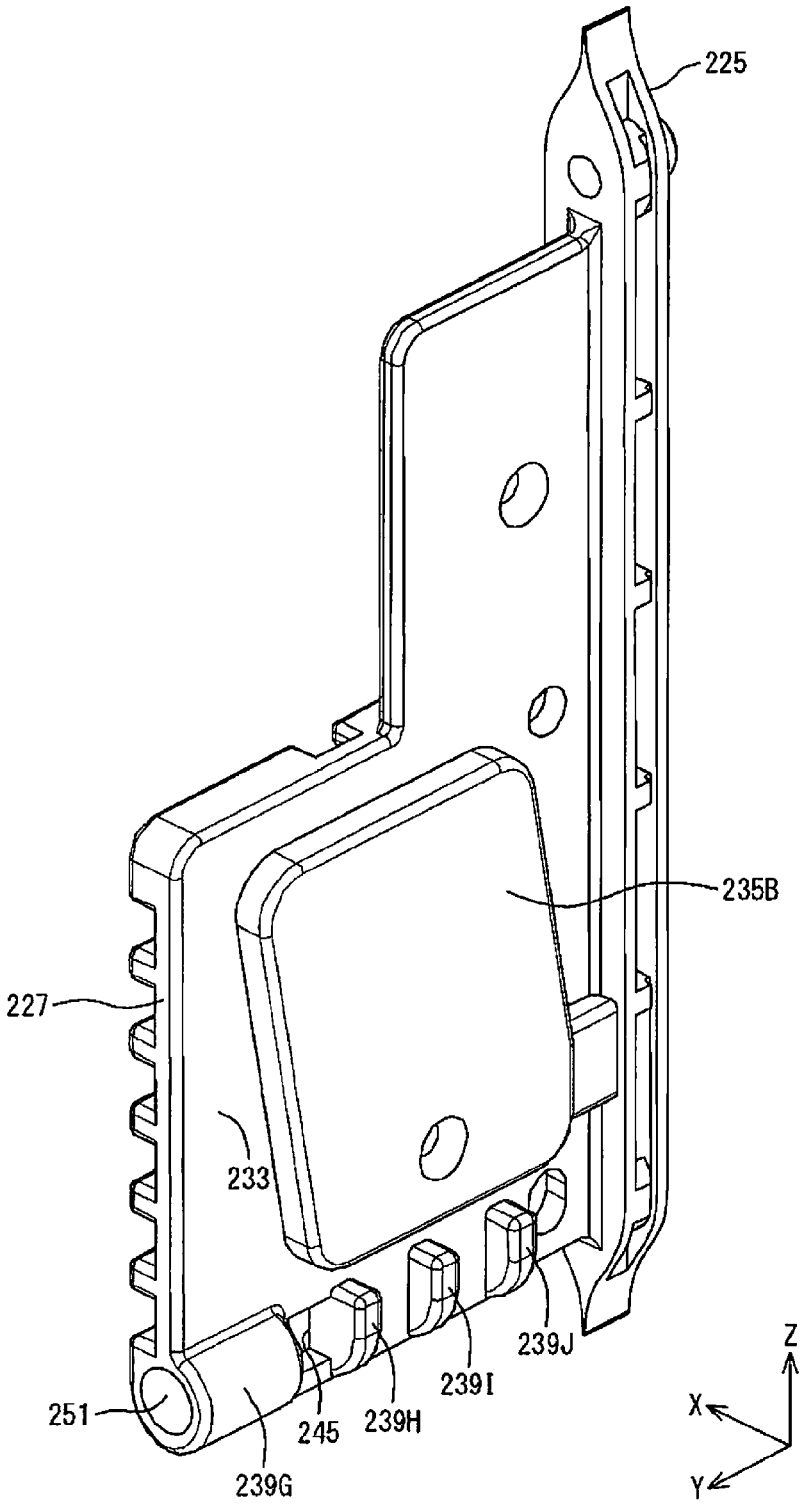
FIG. 22 is a perspective view showing a second channel member in one embodiment.

Here, the raised part 239G also extends to the surface 233, as shown in FIG. 22. In other words, the raised part 239G projects from the surface 231 in the opposite direction to the surface 233 side, and projects from the surface 233 in the opposite direction to the surface 231 side, that is, toward the sheet 82B (FIG. 19) side. Similarly, the raised part 239H, the raised part 239I and the raised part 239J also project from the surface 233 in the opposite direction to the surface 231 side, that is, toward the sheet 82B (FIG. 19) side. A through hole 251 that passes through the raised part 239G along the Y-axis is provided in the raised part 239G. The through hole 251 passes through to the opening 245 on the raised part 239H side of the raised part 239G. A channel that passes through the raised part 239G toward the base 225 side from the first region 227 side and extends to the raised part 239H after passing through the opening 245 is constituted by the through hole 251 and the opening 245.

As shown in FIG. 22, a raised part 235B is provided on the surface 233. The raised part 235B overlaps the area of the recessed part 235 (FIG. 21), in a state where the first region 227 is seen in plan view in the X-axis direction. The recessed part 235 is provided within the area of the surface 231 that overlaps the raised part 235B in plan view. The depth of the recessed part 235 from the surface 231 to the bottom 235A can thereby be increased to greater than the thickness from the surface 231 to the surface 233.

A plurality of ribs 253 are provided inside the recessed part 235, as shown in FIG. 21. Two ribs 253 are provided in the present embodiment. Note that the number of ribs 253 is not limited to two, and there may be one rib or three or more ribs. The two ribs 253 extend along the Y-axis. The two ribs 253 are arranged side by side along the Z-axis with a gap opened up therebetween. The two ribs 253 project from the bottom 235A in the opposite direction to the surface 233 side, that is, toward the sheet 82A (FIG. 19) side. The two ribs 253 protrude from the bottom 235A by less than the depth of the recessed part 235 from the surface 231. The two ribs 253 are thus accommodated further on the bottom 235A side than the surface 231.

A projection 261 is provided on the base 225, as shown in FIG. 21. The projection 261 is provided further in the Z-axis direction than the second region 229. To put it another way, the second region 229 is located further on the first region 227 side than the projection 261, that is, further in the −Z-axis direction than the projection 261. To put it yet another way, the second region 229 is located between the projection 261 and the first region 227 in the Z-axis direction. The projection 261 projects from the surface 225A of the base 225 in the opposite direction to the second region 229 side of the base 225, that is, in the −Y-axis direction. Also, an injection port 263 is provided in the projection 261. The injection port 263 passes through the projection 261 and the base 225 along the Y-axis.

Also, a communication path 265 is provided on the first region 227 side of the base 225. The communication path 265 passes through the base 225 along the Y-axis, and leads into the recessed part 235. The communication path 265 passes through from the surface 225A of the base 225 to a region 241E of the border of the recessed part 235 that is adjacent to the base 225 in the Y-axis direction, as shown in FIG. 18. The communication path 265 thereby leads from the opposite side of the base 225 to the first region 227 side into the recessed part 235 in the Y-axis direction.

Figure 23:
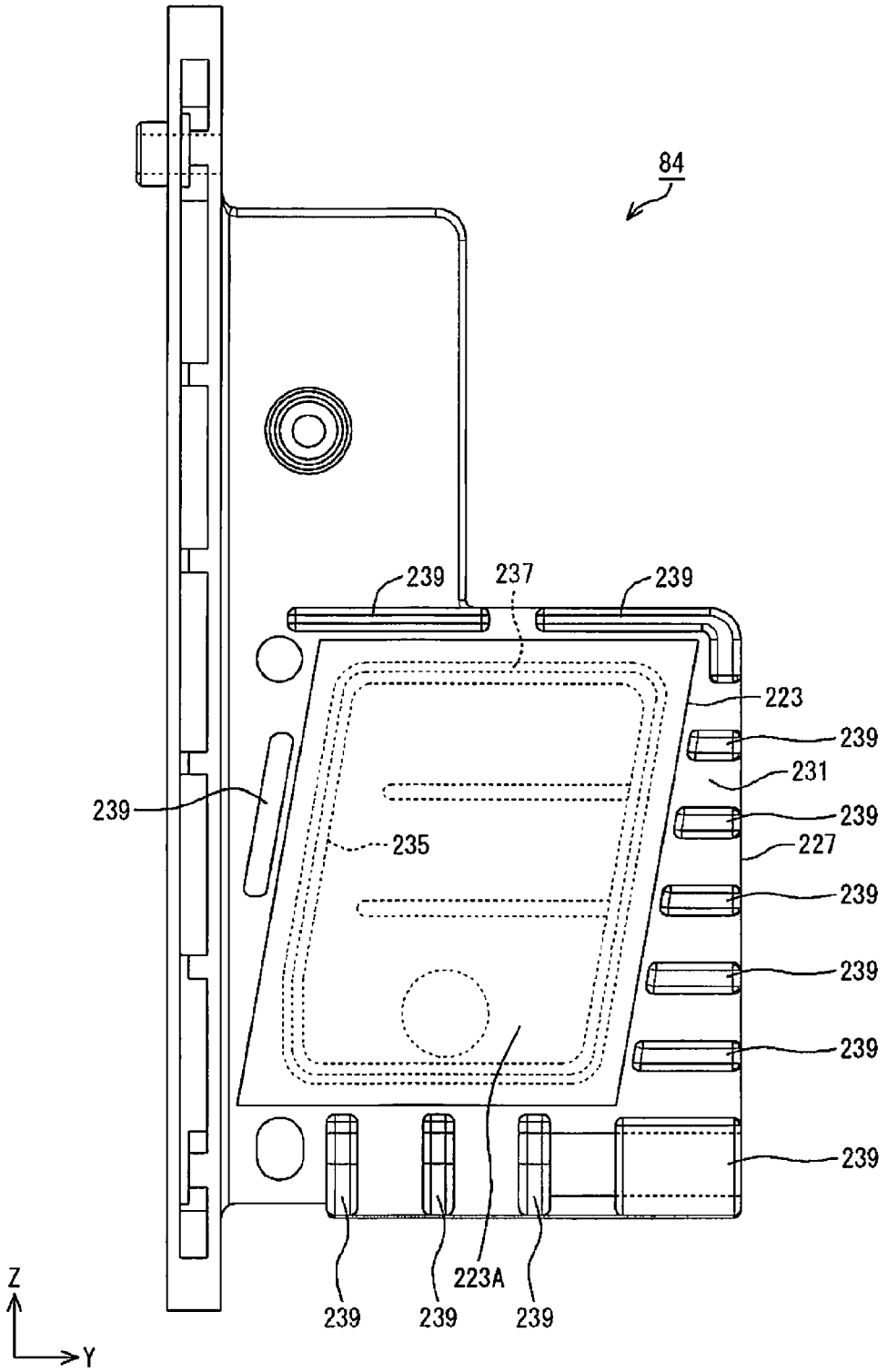
FIG. 23 is a side view showing a filter unit in one embodiment.

The filter 223 faces the surface 231 of the first region 227, as shown in FIG. 23. That is, the filter 223 is provided on the surface 231 side in the first region 227. The largest surface 223A of the filter 223 extends along the surface 231. To put it another way, the filter 223 is provided in parallel with the surface 231. As aforementioned, the first region 227, the surface 89A and the surface 89B are substantially parallel to each other. The largest surface 223A of the filter 223 is thus also substantially parallel to both the surface 89A and the surface 89B.

The filter 223 has a size that covers the recessed part 235. Furthermore, the filter 223 has a size that covers the bank part 237 and the recessed part 235. The filter 223 is joined to the bank part 237 around the entire perimeter of the bank part 237, in a state where the filter 223 covers the bank part 237 and the recessed part 235. In the present embodiment, the filter 223 is welded to the bank part 237. Note that the plurality of raised parts 239 project further in the X-axis direction than the filter 223, in a state where the filter 223 is joined to the bank part 237.

Figure 24:
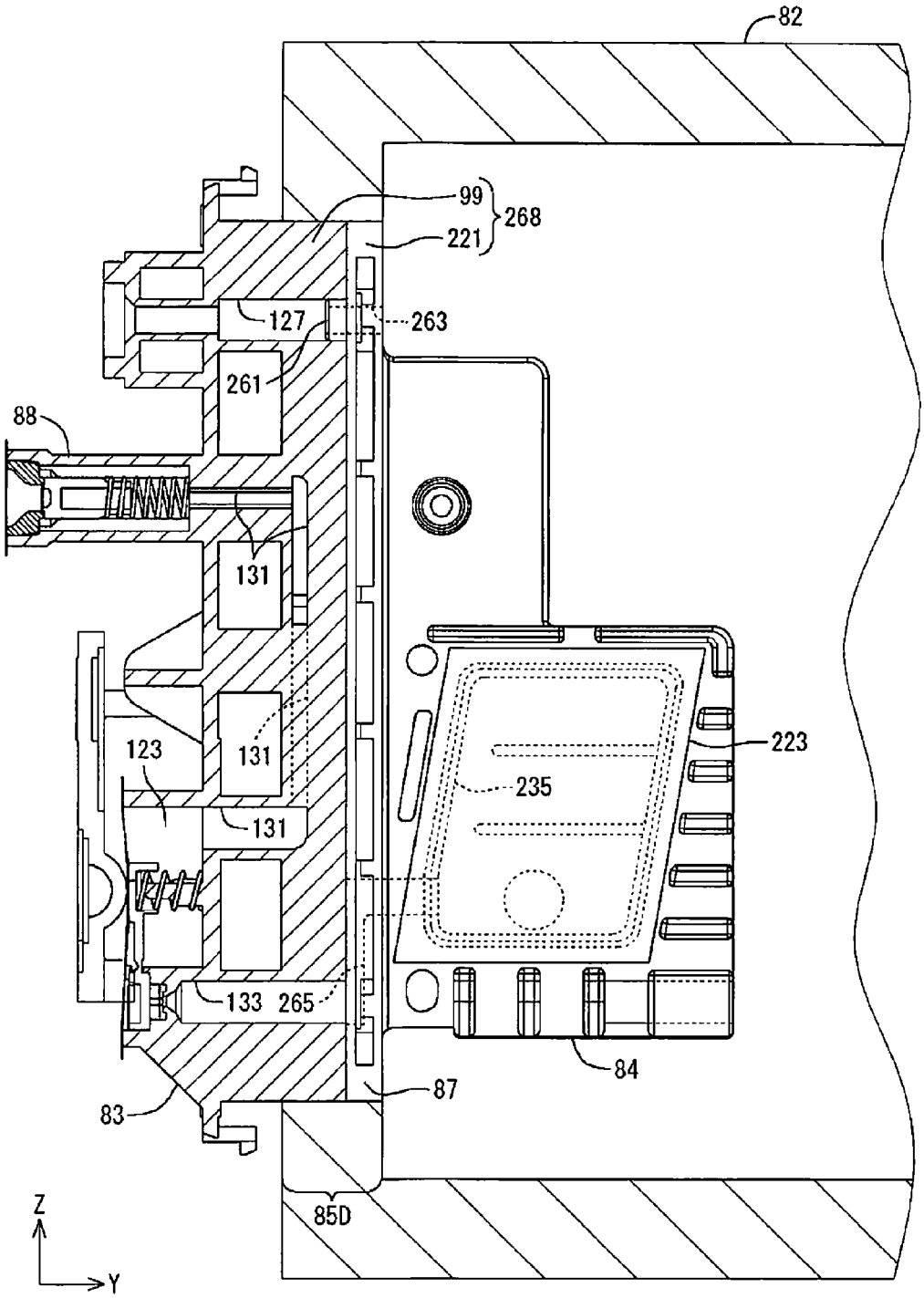
FIG. 24 is a diagram illustrating the configuration of a pack unit in one embodiment.

The channel unit 83 and the filter unit 84 having the above configuration are assembled together, as shown in FIG. 24. Note that, in FIG. 24, the channel unit 83 is illustrated as a cross-sectional view in the YZ plane. The filter unit 84 is provided on the opposite side (ink pack 82 side) to the cavity 123 side of the channel unit 83. The first channel member 99 of the channel unit 83 and the second channel member 221 of the filter unit 84 are assembled together, in a state where a surface 86A (FIG. 7) of the welding part 86 of the first channel member 99 and the surface 225A (FIG. 21) of the base 225 of the second channel member 221 face each other.

In the present embodiment, the projection 261 of the second channel member 221 fits onto the injection port 127 of the first channel member 99, and the communication path 265 is connected to the channel 133 of the first channel member 99. The ink pack 82 is welded to the welding part 86 and the welding part 87, in a state where the channel unit 83 and the filter unit 84 are assembled together in this way. In other words, the join (butt part) of the first channel member 99 and the second channel member 221 is sandwiched (covered) by the ink pack 82. The first channel member 99 is exposed on the outer side of the ink pack 82. On the other hand, the second channel member 221 is housed inside the ink pack 82.

Note that a channel member 268 is constituted by combining the first channel member 99 and the second channel member 221. The channel member 268 is provided to penetrate the ink pack 82 and span between the outside of the ink pack 82 and the inside of the ink pack 82. The ink pack 82 and the channel member 268 thus intersect each other. Also, the ink pack 82 and the channel member 268 are joined in the region where the ink pack 82 and the channel member 268 intersect.

In the channel member 268, the welding part 86 and the welding part 87 each extend around the perimeter of the channel member 268. In other words, in the channel member 268, the welding part 86 and the welding part 87 are sandwiched by the ink pack 82. As aforementioned, the first region 227 and the second region 229 are accommodated within the area that overlaps the base 225 in front view. To put it another way, when the area of the second channel member 221 that is surrounded by the ink pack 82 is seen in plan view, the first region 227 and the second region 229 can also be regarded as being accommodated in that area.

Note that the channel member 268 is not limited to being constituted by two members consisting of the first channel member 99 and the second channel member 221. For example, the channel member 268 can also constituted by one member. Also, the channel member 268 can be constituted by three members or by more than three members. In this case, various configurations can be employed, such as a configuration in which other components are interposed between the first channel member 99 and the second channel member 221, or a configuration in which other components are provided further on the opposite side to the first channel member 99 than the second channel member 221.

According to the above configuration, the inside of the ink pack 82 extends from the filter 223 to the inside of the recessed part 235, and communicates with the inside of the cavity 123 via the communication path 265 and the channel 133. Also, the inside of the cavity 123 communicates with the inside of the supply pipe 88 via the channel 131. In other words, the inside of the ink pack 82 communicates with the outside of the ink pack 82 via the inside of the recessed part 235, the communication path 265, the channel 133, and inside of the cavity 123, the channel 131 and the inside of the supply pipe 88 in this order. The channel from inside the recessed part 235 to within the supply pipe 88 thus constitutes the channel of ink from the inside of the ink pack 82 to the outside of the ink pack 82.

The channel from inside the recessed part 235 to within the supply pipe 88 extends further inside the ink pack 82 than the welding part 87. Also, the filter 223 is provided in a region, of the channel that extend from inside the recessed part 235 to within the supply pipe 88, that is further inside the ink pack 82 than the welding part 87. In other words, the filter 223 is provided upstream of the supply pipe 88 in the channel that extends from inside the ink pack 82 to within the supply pipe 88. Furthermore, the filter 223 is provided upstream of the channel that extends from inside the recessed part 235 to the supply pipe 88.

Also, the inside of the ink pack 82 communicates with the outside of the ink pack 82 via the injection port 263 and the injection port 127. The injection port 127 and the injection port 263 serve as injection paths when injecting ink into the ink pack 82. Note that after ink has been injected into the ink pack 82, the injection port 127 is closed by heat crimping or the like.

Figure 25:
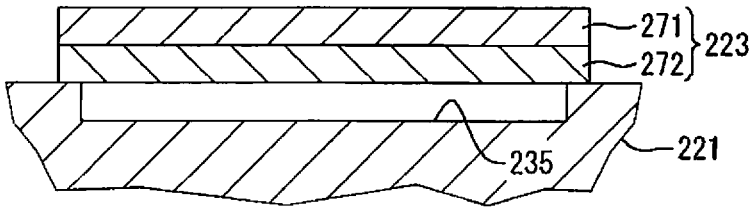
FIG. 25 is a cross-sectional view schematically illustrating the configuration of a filter in one embodiment.

In the present embodiment, the filter 223 has a layered configuration that includes a first filter 271 and a second filter 272, as shown in FIG. 25. In the example shown in FIG. 25, the first filter 271 and second filter 272 lay one on top of the other. Also, in the present embodiment, the surfaces where the first filter 271 and second filter 272 lay one on top of the other are joined to each other.

Note that the layered configuration of the filter 223 is not limited to the example shown in FIG. 25, and a layered configuration in which, for example, other filters or members are interposed between the first filter 271 and the second filter 272 can also be employed. As the layered configuration of the filter 223, a layered configuration in which, for example, other filters and members overlap on the opposite side of the first filter 271 to the second filter 272 side can also be employed. Also, as the layered configuration of the filter 223, a layered configuration in which, for example, other filters and components overlap on the opposite side of the second filter 272 to the first filter 271 side can also be employed.

In the present embodiment, the second filter 272 is provided on the second channel member 221 side. In other words, the second filter 272 is interposed between the first filter 271 and the second channel member 221. The second filter 272 is closer to the recessed part 235 than is the first filter 271. In the channel of ink that is drawn from the inside of the ink pack 82 (FIG. 24) to the outside of the ink pack 82 via the supply pipe 88, the first filter 271 is thus located upstream of the second filter 272. The ink inside the ink pack 82 thus passes through the second filter 272 after passing through the first filter 271, and is drawn to the outside of the ink pack 82 via the supply pipe 88.

Also, in the present embodiment, the first filter 271 and second filter 272 are each constituted by a plurality of fibers laminated in the flow direction of the ink. In the present embodiment, the first filter 271 and second filter 272 thereby each have the shape of nonwoven fabric. Note that, in the present embodiment, metal fibers are employed as the plurality of fibers in both the first filter 271 and the second filter 272.

The plurality of fibers are laminated in the flow direction of the ink, that is, in the direction in which ink passes through the filter 223. The flow direction of the ink is thus a direction that intersects the largest surface 223A of the filter 223 (FIG. 17). In the present embodiment, because the largest surface 223A extends along the YZ plane, the flow direction of the ink is a direction that intersects the YZ plane. Note that the flow direction of the ink is also the thickness direction of the filter 223. In other words, the first filter 271 and second filter 272 are each constituted by a plurality of fibers laminated in the respective thickness directions of the first filter 271 and the second filter 272.

Here, directions that intersect the largest surface 223A include a direction that is orthogonal to the largest surface 223A and directions that intersects the largest surface 223A but are not orthogonal thereto, excluding the direction along the largest surface 223A. Thus, the flow direction of the ink includes a direction along the X-axis that is orthogonal to the YZ plane and a direction that intersects both the YZ plane and the X-axis.

In the present embodiment, the first filter 271 and the second filter 272 differ in coarseness. In the present embodiment, the average fiber diameter of the plurality of fibers constituting the first filter 271 differs from the average fiber diameter of the plurality of fibers constituting the second filter 272. The coarseness of the first filter 271 can thereby be differentiated from the coarseness of the second filter 272. Note that the average fiber diameter is the average value of the outer diameters of the plurality of fibers constituting the first filter 271 and the second filter 272.

Note that, in the present embodiment, the first filter 271 is coarser than the second filter 272. In the present embodiment, the average fiber diameter of the plurality of fibers constituting the first filter 271 is greater than the average fiber diameter of the plurality of fibers constituting the second filter 272. The first filter 271 is thereby formed to be coarser than the second filter 272.

Figure 26:
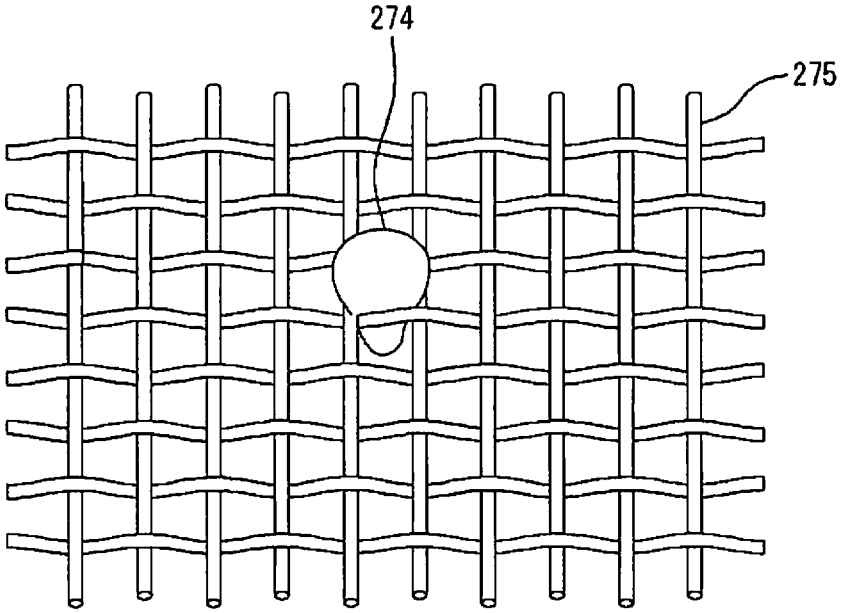
FIG. 26 is a diagram illustrating a mesh filter of existing technology.

As mentioned above, the first filter 271 and second filter 272 each have the shape of nonwoven fabric. Nonwoven fabric is constituted by a plurality of fibers laminated in the thickness direction. Nonwoven fabric thus intricately incorporates gaps through which liquid passes. Therefore, with nonwoven fabric, the channels formed by the gaps through which liquid passes are intricate and long, compared with an existing mesh filter. With nonwoven fabric, the volume of the area capable of catching contaminants (also referred to as the effective filtration volume) is thus large compared with a mesh filter. With a mesh filter, even when contaminants 274 that readily change shape such as gel-like contaminants 274 are caught, the contaminants 274 may end up passing through the mesh filter 275 when the shape of the contaminants 274 changes, as shown in FIG. 26, for example.

In contrast, in the present embodiment, the first filter 271 and second filter 272 are each constituted by a plurality of fibers laminated in the thickness direction. Even when contaminants caught by the first filter 271 and second filter 272 change shape, the contaminants are thus readily prevented from advancing by the plurality of fibers. In other words, even when the contaminants change shape, contaminants that have entered the long and intricately incorporated gaps within the nonwoven fabric are readily caught in the channels formed by the gaps. Therefore, with the pack unit 81 of the present embodiment, the outflow of contaminants can be reduced by the filter 223.

Also, the gap ratio of nonwoven fabric is large compared with a mesh filter. Thus, pressure loss due to the filter 223 can be suppressed to a greater extent than with a mesh filter. As a result, a drop in pressure within the ink pack 82 of the pack unit 81 can be readily mitigated, facilitating the supply of ink from the pack unit 81 to the recording head 19.

Also, in the present embodiment, the filter 223 has a first filter 271 and a second filter 272 provided downstream of the first filter 271. Thus, even when contaminants get through the first filter 271, these contaminants can be caught with the second filter 272. Therefore, with the pack unit 81 of the present embodiment, the outflow of contaminants can be further reduced by the filter 223.

Also, in the present embodiment, the second filter 272 is finer than the first filter 271. Even when contaminants pass through the first filter 271, these contaminants are thus readily caught with the second filter 272. Therefore, with the pack unit 81 of the present embodiment, the outflow of contaminants can be further reduced by the filter 223.

Also, in the present embodiment, the first filter 271 and second filter 272 lay one on top of the other in the filter 223. In other words, in the filter 223, the first filter 271 and second filter 272 contact each other. Thus, even when contaminants appear likely to get through the first filter 271, the contaminants are readily prevented from passing through the first filter 271 by the second filter 272.

Also, in the present embodiment, the surfaces of the first filter 271 and second filter 272 that lay one on top of the other in the filter 223 are joined to each other. The first filter 271 and second filter 272 are thereby integrally constituted, enabling the opening up of gaps between the first filter 271 and the second filter 272 to be suppressed to a low level. Thereby, even when contaminants appear likely to get through the first filter 271, the contaminants are more readily prevented from passing through the first filter 271 by the second filter 272.

Also, in the present embodiment, metal fibers are employed as the plurality of fibers in each of the first filter 271 and the second filter 272. The ink and the filter 223 thus do not readily react to each other and undergo chemical change. Because the ink resistance of the filter 223 is thereby readily enhanced, the reliability of the cartridge 49 is readily enhanced, and therefore the reliability of the liquid jet system 1 is readily enhanced.

Also, in the present embodiment, the filter 223 is provided in the second channel member 221 (FIG. 17). The ink inside the ink pack 82 can thereby be filtered by the filter 223 provided in the second channel member 221. Also, because the filter 223 is provided in the second channel member 221, transportation and assembly of the pack unit 81 is possible without contacting the filter 223, by grasping or holding the second channel member 221.

Also, in the present embodiment, a plurality of raised parts 239 are provided on the second channel member 221 (FIG. 23). The plurality of raised parts 239 surround the perimeter of the filter 223. According to this configuration, the sheet 82A or the sheet 82B contacting the filter 223 is readily avoided when inserting the filter 223 into the bag-like ink pack 82 as one with the second channel member 221. In other words, the filter 223 can be protected with the plurality of raised parts 239. Because damage to the filter 223 can thereby be suppressed to a low level, the reliability of the cartridge 49 is readily enhanced, and therefore the reliability of the liquid jet system 1 is readily enhanced.

The filter unit 84 of the present embodiment is effective for ink that is applied to the printer 3 that is able to print on fabric products such as shirts, for example. With such printing performed on fabric products, there are methods that involve applying ink to the fabric with the printer 3 and drawing a pattern, and then fixing the pattern to the fabric by heating the fabric. Some inks that are applied to such printing on fabric products contain resin additives. With such inks, gel-like contaminants may be produced by the resin material clumping together. Therefore, the filter unit 84 can be effectively applied to such inks.

What is claimed is:

1. A liquid supply unit configured to, with respect to a liquid jet apparatus having a liquid inlet configured to introduce a liquid, supply the liquid to the liquid inlet, comprising:

a liquid housing part configured to house a liquid, the liquid housing part being formed by a flexible sheet member;

a liquid outlet configured to draw the liquid from inside the liquid housing part to outside the liquid housing part; and a filter provided upstream of the liquid outlet in a channel of the liquid that is drawn from inside the liquid housing part to outside the liquid housing part via the liquid outlet, the filter including a first filter and a second filter that are constituted by a plurality of fibers laminated in a flow direction of the liquid, the first filter being provided upstream of the second filter in the channel of the liquid, the first filter and the second filter differing in coarseness, and a largest surface among a plurality of surfaces of the filter being parallel to a largest surface among a plurality of surfaces of the liquid housing part.

2. The liquid supply unit according to claim 1, wherein the first filter is coarser than the second filter.

3. The liquid supply unit according to claim 1, wherein an average fiber diameter of the plurality of fibers in the first filter differs from an average fiber diameter of the plurality of fibers in the second filter.

4. The liquid supply unit according to claim 1, wherein the first filter and the second filter contact each other.

5. The liquid supply unit according to claim 4, wherein the first filter and the second filter are integrally constituted.

6. The liquid supply unit according to claim 1, wherein the plurality of fibers in the first filter and the plurality of fibers in the second filter are metal fibers.

7. The liquid supply unit according to claim 1, wherein the first filter and the second filter are nonwoven fabric.

8. The liquid supply unit according to claim 1, further comprising a channel member constituting at least a portion of the channel leading from inside the liquid housing part to the liquid outlet, wherein the filter is provided in the channel member.

9. The liquid supply unit according to claim 8, wherein the channel member includes a recessed part and a bank part, and the filter is attached to the bank part.

10. The liquid supply unit according to claim 8, wherein the channel member includes a first channel member provided outside the liquid housing part, and a second channel member provided inside the liquid housing part, and a join between the first channel member and the second channel member is welded to the liquid housing part.

11. A liquid supply unit configured to, with respect to a liquid jet apparatus having a liquid inlet configured to introduce a liquid, supply the liquid to the liquid inlet, comprising:

a liquid housing part configured to house a liquid, the liquid housing part being formed by a flexible sheet member;

a liquid outlet configured to draw the liquid from inside the liquid housing part to outside the liquid housing part;

a filter provided upstream of the liquid outlet in a channel of the liquid that is drawn from inside the liquid housing part to outside the liquid housing part via the liquid outlet; and a channel member constituting at least a portion of the channel leading from inside the liquid housing part to the liquid outlet, the filter is provided in the channel member, the filter including a first filter and a second filter that are constituted by a plurality of fibers laminated in a flow direction of the liquid, the first filter being provided upstream of the second filter in the channel of the liquid, the first filter and the second filter differing in coarseness, and the channel member including a convex part protruding outward with respect to the filter toward a largest surface among a plurality of surfaces of the liquid housing part, the convex part being provided in a periphery of the filter and provided upstream of the filter in the channel of the liquid.

12. The liquid supply unit according to claim 11, wherein the convex part includes a plurality of convex portions, and a space is provided between each convex portion.

* * * * *